US009696659B2

(12) United States Patent
Tanaka et al.

(10) Patent No.: US 9,696,659 B2
(45) Date of Patent: Jul. 4, 2017

(54) DEVELOPMENT APPARATUS AND IMAGE FORMING APPARATUS

(71) Applicant: SAMSUNG ELECTRONICS CO., LTD., Suwon-si, Gyeonggi-do (KR)

(72) Inventors: Kenji Tanaka, Yokohama (JP); Naoya Iwata, Yokohama (JP)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/156,879

(22) Filed: May 17, 2016

(65) Prior Publication Data

US 2016/0259269 A1 Sep. 8, 2016

Related U.S. Application Data

(63) Continuation of application No. PCT/KR2014/011345, filed on Nov. 25, 2014.

(30) Foreign Application Priority Data

| | | |
|---|---|---|
| Nov. 26, 2013 | (JP) | 2013-243703 |
| Dec. 3, 2013 | (JP) | 2013-250271 |
| Dec. 9, 2013 | (JP) | 2013-253884 |
| Sep. 3, 2014 | (JP) | 2014-179500 |

(51) Int. Cl.
*G03G 15/08* (2006.01)

(52) U.S. Cl.
CPC ..... *G03G 15/0891* (2013.01); *G03G 15/0893* (2013.01)

(58) Field of Classification Search
CPC ..... G03G 15/0822; G03G 15/0839; G03G 15/0844; G03G 15/0891; G03G 15/0893; G03G 2215/0802; G03G 2215/0838
USPC ..... 399/254, 256, 257
See application file for complete search history.

(56) References Cited

U.S. PATENT DOCUMENTS

| | | | |
|---|---|---|---|
| 6,275,674 | B1 | 8/2001 | Sugimoto |
| 7,039,344 | B2 | 5/2006 | Nishiyama |
| 8,611,797 | B2 | 12/2013 | Maeda |
| 8,620,191 | B2 | 12/2013 | Okazaki et al. |
| 8,824,933 | B2 | 9/2014 | Iwata |

(Continued)

FOREIGN PATENT DOCUMENTS

| | | |
|---|---|---|
| EP | 1 462 868 A3 | 11/2011 |
| EP | 2 597 529 A2 | 5/2013 |

(Continued)

OTHER PUBLICATIONS

International Search Report issued Feb. 24, 2015 in related International Application No. PCT/KR2014/011345.

(Continued)

*Primary Examiner* — Sophia S Chen
(74) *Attorney, Agent, or Firm* — Staas & Halsey LLP

(57) ABSTRACT

A developing apparatus includes a first auger and a second auger for respectively conveying a developer in a first direction and a second direction, an opening for delivering the developer from the first auger to the second auger, a discharger located in the first direction from the opening to discharge the developer conveyed by the first auger, and a retention member provided on at least one of the first auger and the second auger to retain the developer circulated by the first and second augers.

20 Claims, 30 Drawing Sheets

(56) References Cited

U.S. PATENT DOCUMENTS

| | | | | |
|---|---|---|---|---|
| 8,977,169 | B2 | 3/2015 | Shimizu et al. | |
| 2009/0092419 | A1 | 4/2009 | Iwata et al. | |
| 2009/0190960 | A1 | 7/2009 | Hirayama et al. | |
| 2010/0104305 | A1 | 4/2010 | Morimoto | |
| 2010/0215406 | A1* | 8/2010 | Ozawa | G03G 15/0893 399/257 |
| 2010/0232838 | A1 | 9/2010 | Iwamura | |
| 2010/0290816 | A1 | 11/2010 | Yoon et al. | |
| 2011/0013943 | A1* | 1/2011 | Sakamoto | G03G 15/0893 399/254 |
| 2011/0222914 | A1* | 9/2011 | Yoshihara | G03G 15/0822 399/258 |
| 2011/0311279 | A1 | 12/2011 | Okazaki et al. | |

FOREIGN PATENT DOCUMENTS

| | | |
|---|---|---|
| JP | 3-227168 | 10/1991 |
| JP | 10-123811 | 5/1998 |
| JP | 2001-265098 | 9/2001 |
| JP | 2001-265112 | 9/2001 |
| JP | 2002-318491 | 10/2002 |
| JP | 2004-151354 | 5/2004 |
| JP | 2008-250290 | 10/2008 |
| JP | 2008-256917 | 10/2008 |
| JP | 2010-25987 | 2/2010 |
| JP | 2010-79116 | 4/2010 |
| JP | 2010-237328 | 10/2010 |
| JP | 2011-137870 | 7/2011 |
| JP | 2012-3193 | 1/2012 |
| JP | 2012-103423 | 5/2012 |
| JP | 5003780 | 6/2012 |
| JP | 2013-25123 | 2/2013 |
| JP | 2013-113894 | 6/2013 |

OTHER PUBLICATIONS

"Monochrome multifunction machine "DocuCentre f1100"", http://www.fujixerox.co.jpprofuctdocucentre_f1100.txt, Jul. 6, 2016, 2 pages.

"WorkCentre 7132, Color Multifunction Printers: Xerox", http://www.office.xerox.com/multifunction-printer/color-multifunction/workcentre-7, Jul. 6, 2016, 1 page.

"Merchandise information" http://www.fujixerox.co.jp-productdocuprinte_cg835.txt, Jul. 6, 2016, 3 pages.

International Search Report mailed Feb. 24, 2015, in corresponding International Application No. PCT/KR2014/011345.

Extended European Search Report dated May 26, 2017 in European Patent Application No. 14865518.6.

* cited by examiner

| ROTATION SPEED | CURRENT EMBODIMENT | WITHOUT ADDITIONAL AGITATING BLADE |
|---|---|---|
| HIGH | 220g | 220g |
| LOW | 245g | 280g |

DEVELOPMENT APPARATUS AND IMAGE FORMING APPARATUS

CROSS-REFERENCE TO RELATED APPLICATIONS

This is a continuation application, filed under 35 U.S.C. §111(a), of International Application PCT/KR2014/011345, filed Nov. 25, 2014, it being further noted that foreign priority benefit is based upon Japanese Patent Application No. 2013-243703, filed Nov. 26, 2013, Japanese Patent Application No. 2013-250271, filed Dec. 3, 2013, Japanese Patent Application No. 2013-253884, filed Dec. 9, 2013, and Japanese Patent Application No. 2014-179500, filed Sep. 3, 2014.

TECHNICAL FIELD

The present invention relates to a developing apparatus and an image forming apparatus which employ a trickle development scheme and, more particularly, to a developing apparatus and an image forming apparatus which develop an image by circulating a developer including a toner and a carrier along a circulation route.

BACKGROUND ART

An image forming apparatus using electrophotography is an apparatus for forming an image by forming electrostatic latent images on outer circumferential surfaces of uniformly charged photoreceptor drums and visualizing the electrostatic latent images using toners. In the image forming apparatus which develops an image using a 2-component developer including a toner and a carrier, the toner and the carrier are mixed and stirred by an agitating means provided in a developing apparatus to achieve a uniform ratio thereof. In addition, for a long life of the developer, a trickle development scheme for mixing a new carrier with a new toner before the toner is replenished into a developer container, and overflowing the old developer based on an increase in volume of the developer inside the developer container to discharge the developer from a developer discharge port is employed.

(Patent Document 1) JP2001-265098 A
(Patent Document 2) JP2008-250290 A
(Patent Document 3) JP2010-79116 A
(Patent Document 4) JP2013-25123 A

DETAILED DESCRIPTION OF THE INVENTION

Technical Problem

Although a developer should be stably retained near a developer discharge port to control a discharge amount of the developer, a retention space may lead to an increase in apparatus size.

In addition, implementation of a developing apparatus capable of reducing a manufacturing cost and having a simple configuration is required in the field of image forming apparatuses. However, the amount of the developer inside the developing apparatus may easily vary based on an installation environment of the image forming apparatus, the material of the developer, a process speed of the image forming apparatus, or the like. Since the image forming apparatuses currently operate at a high process speed, the amount of the developer may greatly vary. Accordingly, stabilization of the amount of the developer filled inside the developing apparatus is required.

The present invention provides a developing apparatus and an image forming apparatus capable of suppressing increases in an apparatus size and a manufacturing cost and stabilizing the amount of a developer.

The present invention provides a developing apparatus and an image forming apparatus capable of maintaining a stable amount of a developer even when a process speed varies.

The present invention provides a developing apparatus and an image forming apparatus capable of stabilizing the amount of a developer and coping with a high process speed of the image forming apparatus by suppressing a reduction in the amount of the developer caused by dispersion of the developer.

Technical Solution

According to an aspect of the present invention, a developing apparatus includes a first auger for conveying a developer in a first direction, a second auger extending in parallel to the first auger to convey the developer in a second direction opposite to the first direction, an opening for delivering the developer from the first auger to the second auger, a discharger located in the first direction from the opening to discharge the developer conveyed by the first auger, and a retention means provided on at least one of the first auger and the second auger to retain the developer circulated by the first and second augers.

The retention means may retain the developer near the opening.

The retention means may include a first retention means provided at a location of the second auger facing the opening to retain the developer delivered through the opening toward the second auger, near the opening.

The retention means may further include a second retention means provided on the second auger at a downstream side of the first retention means based on the second direction to retain the developer conveyed by the second auger.

A developer retention capability of the second retention means may be lower than the developer retention capability of the first retention means.

The second retention means may be provided at a location within a range corresponding to 1.5 times of a pitch of a spiral blade of the second auger from the first retention means.

Each of the first and second retention means may include at least one of a paddle extending from a rotation shaft of the second auger in an axial direction and a radial direction, a spiral blade having a pitch smaller than that of a spiral blade of the second auger, and a diameter-enlarged part having a diameter greater than the diameter of the rotation shaft of the second auger.

A reverse conveyer for reversing flow of the developer conveyed in the first direction may be provided at a location of the first auger between the discharger and the opening.

When an angle formed between a horizontal plane and a straight line for interconnecting a rotation center of the first auger and a rotation center of the second auger is denoted by $\theta$, $45° \leq \theta \leq 90°$ may be satisfied.

The discharger may include a developer discharge port provided in a wall of a developer container for accommodating the developer, to face the first auger, the developer discharge port may be provided in the wall in a direction moving from a lower side toward an upper side of a gravity direction when the first auger rotates, and a lower end of the developer discharge port may be located at an upper side of the gravity direction compared to a rotation center of a rotation shaft of the first auger.

The first auger may include a conveying blade spirally provided on an outer circumferential surface of the rotation shaft, and a number of blade loops of the conveying blade at a location of the first auger facing the developer discharge port may be greater than that of another region.

The retention means may include a plurality of paddle members provided at a location of the first auger facing the developer discharge port at different locations in an axial direction of the rotation shaft.

The plurality of paddle members may discharge the developer through the developer discharge port by applying a force to the developer when the first auger rotates.

At least one of the plurality of paddle members may have a different height from a center of the rotation shaft compared to others.

The plurality of paddle members may be provided at the same location in a rotation direction of the rotation shaft.

The first auger may include a first reverse conveyer provided at a location between the discharger and the opening to reverse flow of the developer conveyed in the first direction, a discharge conveyer located in the first direction from the first reverse conveyer to convey the developer in the first direction, and a second reverse conveyer located between the first reverse conveyer and the discharge conveyer to reverse flow of the developer.

When an amount of the developer conveyed by the first reverse conveyer is denoted by V1 and an amount of the developer conveyed by the second reverse conveyer is denoted by V2, V1>V2 may be satisfied.

When an amount of the developer conveyed by the discharge conveyer is denoted by V3, V2<V3 may be satisfied.

A rotation speed of the first auger may be equal to or higher than 400 rpm.

According to another aspect of the present invention, an image forming apparatus includes the above developing apparatus.

Advantageous Effects of the Invention

According to the above description, increases in an apparatus size and a manufacturing cost may be suppressed and the amount of a developer may be stabilized.

According to the above description, a stable amount of a developer may be maintained even when a process speed of a developing apparatus varies.

According to the above description, the amount of a developer may be stabilized and a high process speed of an image forming apparatus may be coped with by suppressing a reduction in the amount of the developer caused by dispersion of the developer.

DESCRIPTION OF THE DRAWINGS

FIG. 19A shows the state of a developer in a case when a rotation speed of the first agitating and conveying member is low and FIG. 19B shows the state of the developer in a case when the rotation speed of the first agitating and conveying member is high.

FIG. 20A shows a case when the rotation speed of the first agitating and conveying member is low and FIG. 20B shows a case when the rotation speed of the first agitating and conveying member is high.

FIG. 21A shows the state of the developer in a case when the rotation speed of the first agitating and conveying member is low and FIG. 21B shows the state of the developer in a case when the rotation speed of the first agitating and conveying member is high.

MODE OF THE INVENTION

Hereinafter, the present invention will be described in detail by explaining embodiments of the invention with reference to the attached drawings.

First Embodiment

Figure 1:
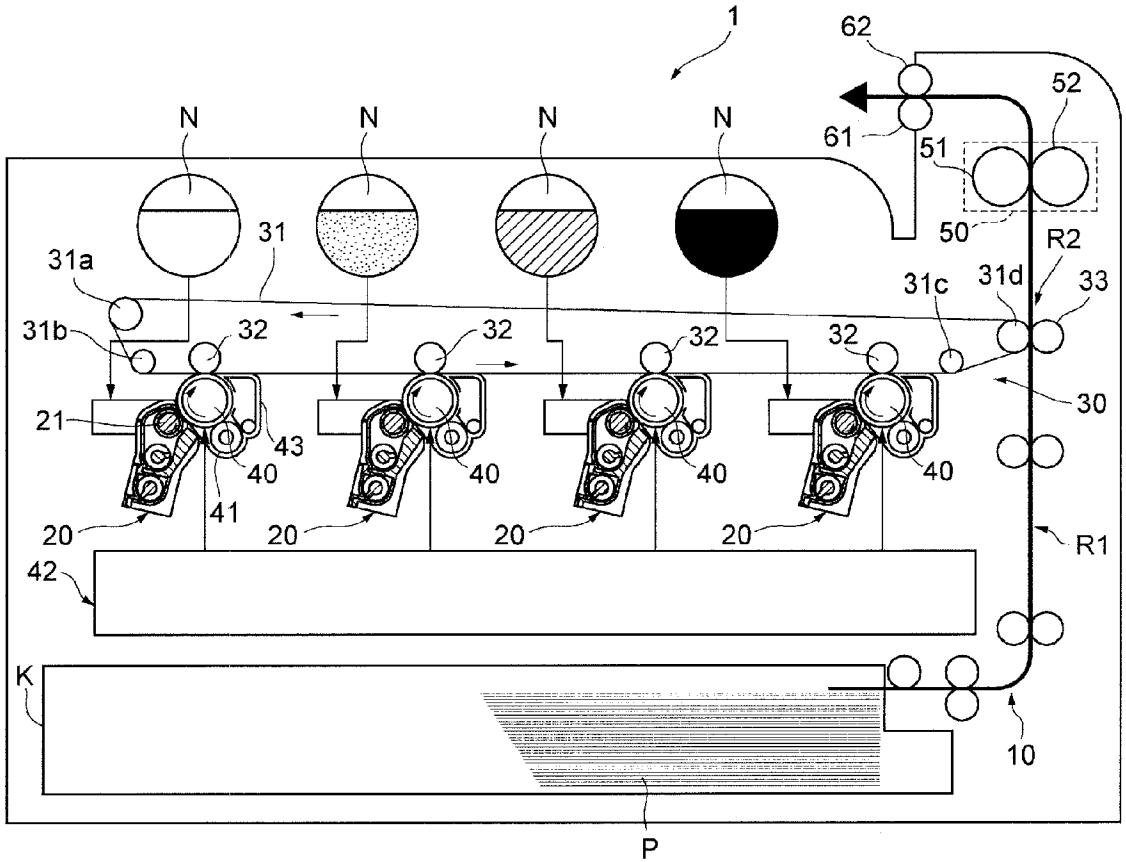
FIG. 1 is a structural view of an image forming apparatus including developing apparatuses, according to a first embodiment of the present invention.

An image forming apparatus 1 according to the current embodiment is an apparatus for forming a color image using magenta, yellow, cyan, and black. As illustrated in FIG. 1, the image forming apparatus 1 includes a recording medium conveying unit 10 for conveying paper P, developing apparatuses 20 for developing electrostatic latent images, a transfer unit 30 for secondarily transferring toner images onto the paper P, photoreceptor drums 40 for providing the electrostatic latent images on circumferential surfaces thereof, and a fixing unit 50 for fixing the toner images to the paper P.

The recording medium conveying unit 10 accommodates the paper P as a recording medium for forming an image thereon and conveys the paper P along a route R1. The paper P is accommodated in a cassette K in a stack. The recording medium conveying unit 10 conveys the paper P along the route R1 to a secondary transfer region R2 at a timing when the toner images to be transferred onto the paper P reach the secondary transfer region R2.

Four developing apparatuses 20 are provided to respectively correspond to the four colors. Each developing apparatus 20 includes a developing roller 21 for providing a toner to the photoreceptor drum 40. The developing apparatus 20 controls the toner and a carrier to a desired mixing ratio. The developing apparatus 20 mixes and agitates the toner and the carrier to uniformly disperse the toner within a developer and thus achieves an optimal charge amount of the developer. The developer is provided to the developing roller 21. When the developer is conveyed to a region facing the photoreceptor drum 40 due to rotation of the developing roller 21, the toner of the developer provided to the developing roller 21 moves to the electrostatic latent image formed on the circumferential surface of the photoreceptor drum 40 and thus the electrostatic latent image is developed. In addition, to maintain the charge amount of the developer inside the developing apparatus 20 constant, a trickle development scheme for replenishing the toner and the carrier filled together with the toner in a toner tank N into the developing apparatus 20, and discharging the deteriorated developer from the developing apparatus 20 is employed. The discharged and deteriorated developer is accommodated in a waste toner collecting apparatus (not shown).

The transfer unit 30 conveys the toner images formed by the developing apparatuses 20 to the secondary transfer region R2 to secondarily transfer the toner image onto the paper P. The transfer unit 30 includes a transfer belt 31, suspending rollers 31*a*, 31*b*, 31*c*, and 31*d* for suspending the transfer belt 31, primary transfer rollers 32 facing the photoreceptor drums 40 by intervening the transfer belt 31 therebetween, and a secondary transfer roller 33 facing the suspending roller 31*d* by intervening the transfer belt 31 therebetween.

The transfer belt 31 is an endless belt which is circularly moved by the suspending rollers 31*a*, 31*b*, 31*c*, and 31*d*. The primary transfer rollers 32 are provided to press the photoreceptor drums 40 from an inner circumferential surface of the transfer belt 31. The secondary transfer roller 33 is provided to press the suspending roller 31*d* from an outer circumferential surface of the transfer belt 31.

Four photoreceptor drums 40 are provided to respectively correspond to the four colors. The photoreceptor drums 40 are provided along a moving direction of the transfer belt 31. The developing apparatus 20, a charging roller 41, an exposure unit 42, and a cleaning unit 43 are provided around each photoreceptor drum 40.

The charging roller 41 uniformly charges the surface of the photoreceptor drum 40 to a predetermined potential. The exposure unit 42 exposes the surface of the photoreceptor drum 40 charged by the charging roller 41 based on image information to be formed on the paper P. As such, the potential of a part of the surface of the photoreceptor drum 40 exposed by the exposure unit 42 is changed and thus an electrostatic latent image is formed. Each of the four developing apparatuses 20 generates a toner image by developing the electrostatic latent image formed on the photoreceptor drum 40 using a toner supplied from the toner tank N corresponding to the developing apparatus 20. Magenta, yellow, cyan, and black toners and carriers are individually filled in the toner tanks N. The cleaning unit 43 collects the toner remaining on the photoreceptor drum 40 after primary transfer.

The fixing unit 50 attaches and fixes the toner images secondarily transferred from the transfer belt 31 onto the paper P to the paper P. The fixing unit 50 includes a heating roller 51 for heating the paper P, and a pressing roller 52 for pressing the heating roller 51. The heating roller 51 and the pressing roller 52 may have cylindrical shapes. A heat source such as a halogen lamp may be provided in the heating roller 51. A fixing nip, which is a contact region, is generated between the heating roller 51 and the pressing roller 52. By passing the paper P through the fixing nip, the toner images are melted and fixed to the paper P.

In addition, the image forming apparatus 1 includes discharge rollers 61 and 62 for discharging the paper P, to which the toner images are fixed by the fixing unit 50, out of the image forming apparatus 1.

A description is now given of operation of the image forming apparatus 1. When an image signal to be printed is input to the image forming apparatus 1, a controller (not shown) of the image forming apparatus 1 uniformly charges the surfaces of the photoreceptor drums 40 to a predetermined potential using the charging rollers 41, and irradiates laser beams onto the surfaces of the photoreceptor drums 40 using the exposure unit 42 based on the input image signal to form electrostatic latent images.

The developing apparatuses 20 form toner images by developing the electrostatic latent images. The toner images formed as described above are primarily transferred from the photoreceptor drums 40 onto the transfer belt 31 in regions where the photoreceptor drums 40 and the transfer belt 31 face each other. The toner images transferred from the four photoreceptor drums 40 are sequentially stacked on the transfer belt 31 to form a single stacked toner image. The stacked toner image is secondarily transferred onto the paper P conveyed from the recording medium conveying unit 10 in the secondary transfer region R2 where the suspending roller 31*d* and the secondary transfer roller 33 face each other.

The paper P, onto which the stacked toner image is secondarily transferred, is conveyed to the fixing unit 50. By passing the paper P between the heating roller 51 and the pressing roller 52 with heat and pressure, the stacked toner image is melted and fixed to the paper P. Thereafter, the paper P is discharged out of the image forming apparatus 1 by the discharge rollers 61 and 62.

A detailed description is now given of the developing apparatus 20.

Figure 2:
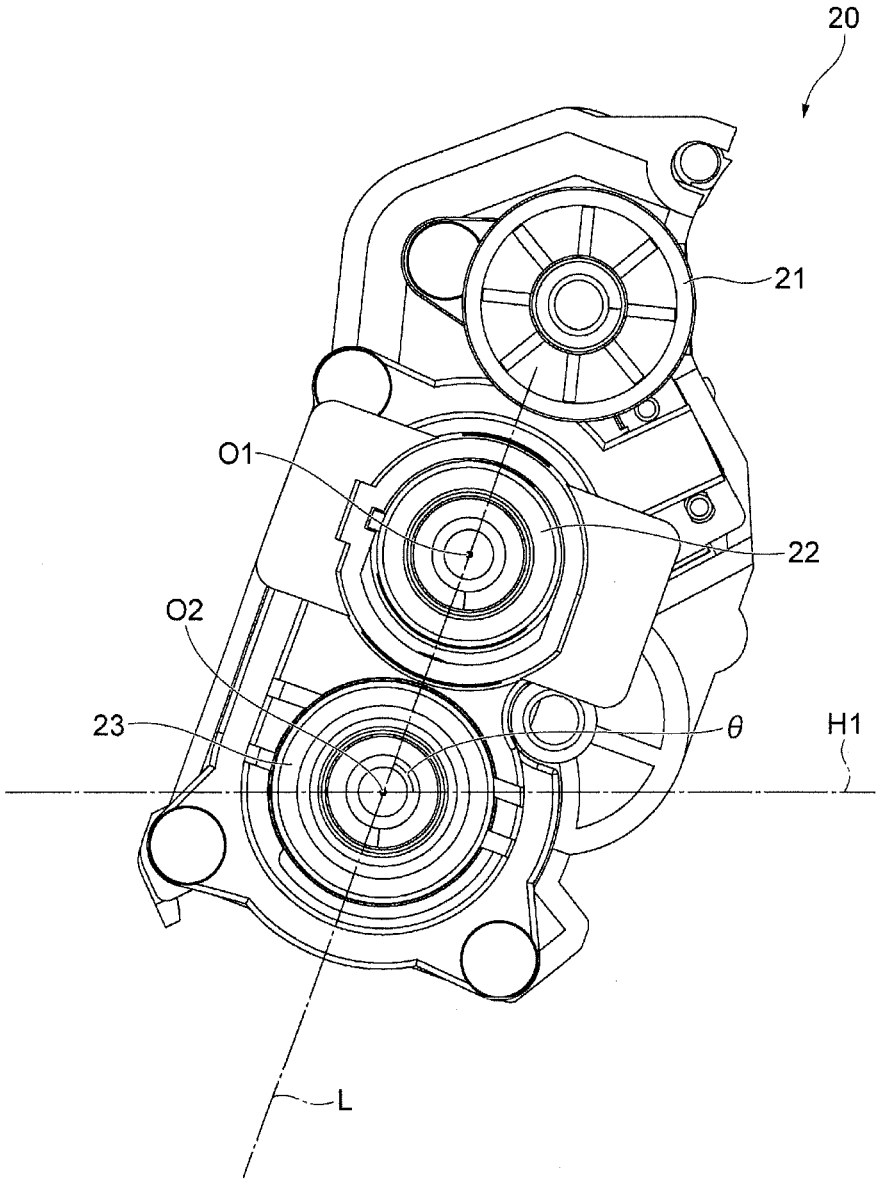
FIG. 2 is a side view of the developing apparatus included in the image forming apparatus of FIG. 1.
Figure 3:
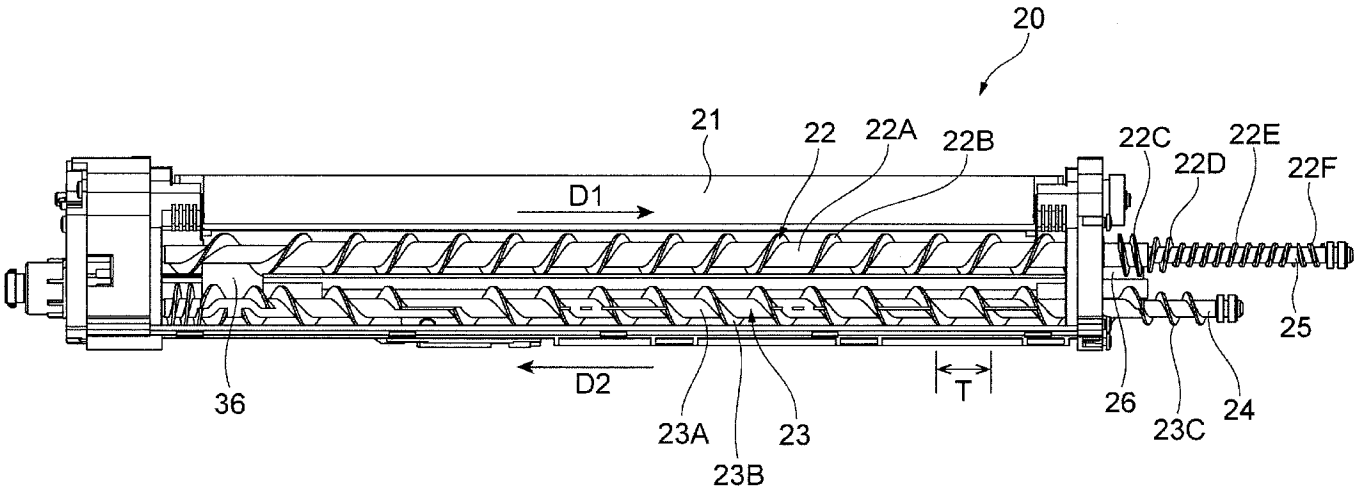
FIG. 3 is a view illustrating two augers included in the developing apparatus of FIG. 2.

The developing apparatus 20 according to the current embodiment develops an image using a 2-component developing scheme. As illustrated in FIGS. 2 and 3, the developer accommodated in the toner tank N and including the toner and the carrier is replenished into the developing apparatus 20 through a developer replenisher 24, and the deteriorated developer is discharged out of the developing apparatus 20 through a developer discharger 25 in an overflow manner. In addition to the above-described developing roller 21, the developing apparatus 20 includes a supply auger (first auger) 22 for supplying the developer to the developing roller 21, and an admix auger (second auger) 23 extending in parallel to the supply auger 22 and provided diagonally under the supply auger 22. When an angle formed between a horizontal plane H1 and a straight line L for interconnecting a rotation center O1 of the supply auger 22 and a rotation center O2 of the admix auger 23 is denoted by $\theta$, $45° \leq \theta \leq 90°$ is satisfied. The developer replenisher 24 is provided at one end of the admix auger 23, and the developer discharger 25 is provided at one end of the supply auger 22.

The supply auger 22 is an auger for supplying the developer to the developing roller 21. The supply auger 22 includes a rotation shaft 22A and a spiral blade 22B spirally protruding from the rotation shaft 22A. The supply auger 22 conveys the developer replenished from the developer replenisher 24 into the developing apparatus 20 in a first direction D1. Herein, the first direction D1 is an axial direction of the supply auger 22 and is a direction in which the developer discharger 25 is provided with respect to the spiral blade 22B. When the rotation shaft 22A is rotated by a driving apparatus (not shown), the spiral blade 22B moves in the first direction D1 and thus the developer is conveyed in the first direction D1 by the spiral blade 22B.

The admix auger 23 includes a rotation shaft 23A and a spiral blade (protrusion) 23B spirally protruding from the rotation shaft 23A. The admix auger 23 conveys the developer replenished from the developer replenisher 24 into the developing apparatus 20 in a second direction D2. That is, when the rotation shaft 23A is rotated by a driving apparatus (not shown), the spiral blade 23B moves in the second direction D2 and thus the developer is conveyed in the second direction D2 by the spiral blade 23B. The second direction D2 is a direction opposite to the first direction D1.

A first opening 26 for delivering the developer from the supply auger 22 to the admix auger 23 is provided at ends of the supply auger 22 and the admix auger 23 in the first direction D1. A second opening 36 for delivering the developer from the admix auger 23 to the supply auger 22 is provided at other ends of the supply auger 22 and the admix auger 23 in the second direction D2.

The supply auger 22 includes a reverse spiral blade (reverse conveyer) 22C located in the first direction D1 from the first opening 26 to reverse the direction of the developer flowing in the first direction D1. The reverse spiral blade 22C moves in the second direction D2 when the rotation shaft 22A of the supply auger 22 rotates. The developer discharger 25 is located in the first direction D1 from the reverse spiral blade 22C. The diameter of the reverse spiral blade 22C is nearly equal to the diameter of the spiral blade 22B, but the pitch of the reverse spiral blade 22C is less than the pitch of the spiral blade 22B. Herein, the pitch refers to an interval T between two adjacent axial-direction parts of each spiral blade.

Spiral blades 22D and 22E, which move in the first direction D1 when the rotation shaft 22A rotates, and a reverse spiral blade 22F, which moves in the second direction D2 when the rotation shaft 22A rotates, are provided in the first direction D1 from the reverse spiral blade 22C. The pitch of the spiral blade 22D is nearly equal to the pitch of the reverse spiral blade 22C, but the diameter of the spiral blade 22D is less than the diameter of the reverse spiral blade 22C. The pitch of the spiral blade 22E is nearly equal to the pitch of the spiral blade 22D, but the diameter of the spiral blade 22E is less than the diameter of the spiral blade 22D.

As described above, since the spiral blades 22D and 22E are provided in the first direction D1 from the reverse spiral blade 22C, the developer that passed through the reverse spiral blade 22C is conveyed to the developer discharger 25 by the spiral blades 22D and 22E and is discharged out of the developing apparatus 20. The reverse spiral blade 22F is located across the developer discharger 25 from the spiral blade 22E. The pitch and the diameter of the reverse spiral blade 22F are nearly equal to the pitch and the diameter of the spiral blade 22E.

In addition, the admix auger 23 includes a spiral blade 23C located in the first direction D1 from the first opening 26 to move in the second direction D2 when the rotation shaft 23A rotates. The developer replenished from the developer replenisher 24 is conveyed in the second direction D2 by the spiral blade 23C. The diameter and the pitch of the spiral blade 23C are less than the diameter and the pitch of the spiral blade 23B provided in the second direction D2 from the first opening 26. Accordingly, the developer replenished from the developer replenisher 24 is conveyed by the spiral blade 23C and then is conveyed by the spiral blade 23B at a higher speed.

Figure 4:
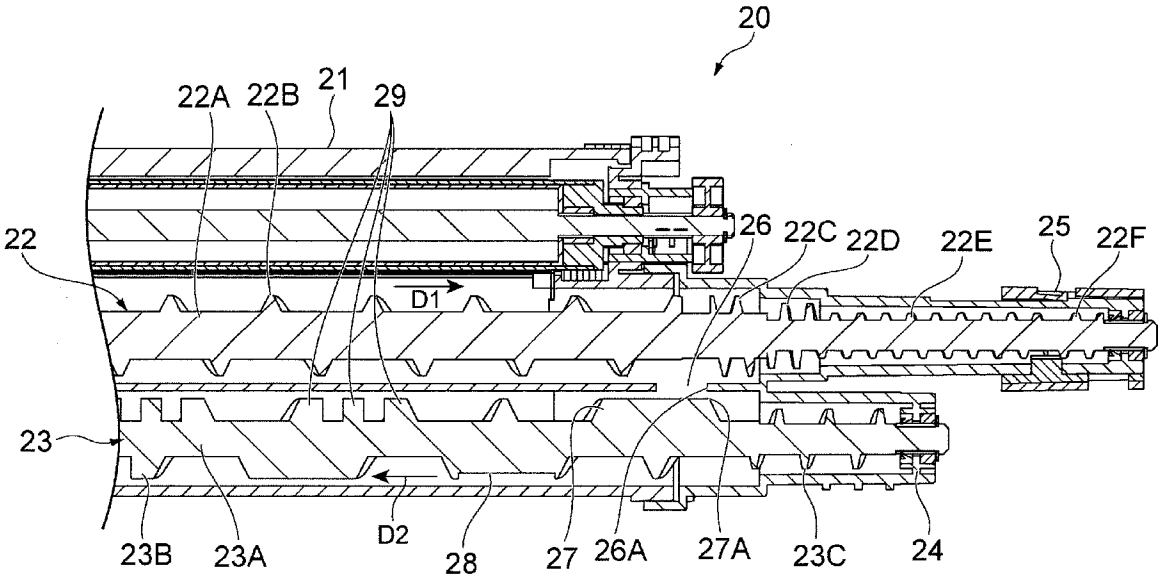
FIG. 4 is a cross-sectional view showing the two augers at the vicinity of a developer discharger of FIG. 3.

As illustrated in FIG. 4, the admix auger 23 includes a first paddle (first retention means) 27 located to face the first opening 26. The first paddle 27 retains the developer, which moves from the supply auger 22 toward the admix auger 23, at a location facing the first opening 26. By retaining the developer as described above, the first paddle 27 may control the amount of the developer to be discharged by the developer discharger 25.

Figure 5:
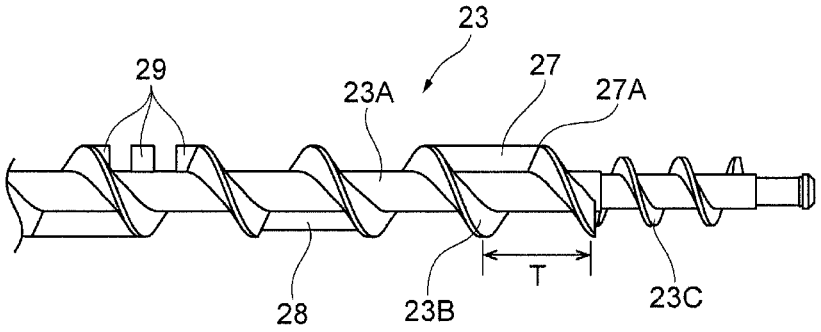
FIG. 5 is a side view of an admix auger of FIG. 4.

As illustrated in FIGS. 4 and 5, the first paddle 27 is provided between two adjacent parts of the spiral blade 23B in an axial direction of the admix auger 23. The height of the first paddle 27 with respect to the rotation shaft 23A is nearly equal to the height of the spiral blade 23B with respect to the rotation shaft 23A. The first paddle 27 has a plate shape extending in the axial direction and a diameter direction of the admix auger 23. The location of an end 27A of the first paddle 27 in the first direction D1 is nearly equal to the location of an end 26A of the first opening 26 in the first direction D1.

The admix auger 23 may further include a second paddle (second retention means) 28 located in the second direction D2 from the first paddle 27. The second paddle 28 is provided at a location corresponding to 1.5 pitches (a phase difference of 540°) in the second direction D2 from the first paddle 27. The second paddle 28 retains the developer at a downstream side of the first opening 26 on a route of the developer. The second paddle 28 interconnects two adjacent parts of the spiral blade 23B in the axial direction of the admix auger 23, and has a plate shape like the first paddle 27.

The height of the second paddle 28 with respect to the rotation shaft 23A is less than the height of the first paddle 27 with respect to the rotation shaft 23A. Accordingly, the capability of retaining the developer by the second paddle 28 is lower than the capability of retaining the developer by the first paddle 27. A scheme for lowering the retention capability of the second paddle 28 compared to the retention capability of the first paddle 27 is not limited to the above-described scheme for reducing the height of a paddle with respect to a rotation shaft. For example, the retention capability may also be lowered by reducing the diameter of a rotation shaft or by increasing the pitch of a spiral blade.

The admix auger 23 may further include an agitator 29 located in the second direction D2 from the second paddle 28 to promote agitation of the developer. The agitator 29 has a rectangular plate shape protruding from the rotation shaft 23A between two adjacent parts of the spiral blade 23B in the axial direction of the admix auger 23. Using the agitator 29, the developer conveyed by the admix auger 23 may be sufficiently agitated.

As described above, in the developing apparatus 20 and the image forming apparatus 1 including the developing apparatus 20, the first paddle 27 is provided at the location facing the first opening 26 of the admix auger 23, and the second paddle 28 is provided in the second direction D2 from the first paddle 27 of the admix auger 23. Accordingly, when a large amount of the developer moves from the supply auger 22 through the first opening 26, the developer is lifted toward the supply auger 22 by the first paddle 27 and thus a large amount of the developer does not enter the admix auger 23.

In addition, the developer lifted by the first paddle 27 may be moved over the reverse spiral blade 22C in the first direction D1 by the supply auger 22 and thus the developer may be efficiently discharged when a large amount of the developer enters. Furthermore, the second paddle 28 provided in the second direction D2 from the first paddle 27 may restrict the amount of the developer moved by the admix auger 23. As described above, since the first paddle 27 and the second paddle 28 may perform two-step restriction to retain the developer near the reverse spiral blade 22C, the amount of the developer inside the developing apparatus 20 may be stabilized without increasing an apparatus size and an apparatus manufacturing cost. Specifically, the speed of discharging the developer by the developer discharger 25 may be controlled using the first paddle 27, and the amount of the developer supplied into the developing apparatus 20 may be controlled using the second paddle 28.

Besides, the location of the end 27A of the first paddle 27 in the first direction D1 is nearly equal to the location of the end 26A of the first opening 26 in the first direction D1. Herein, if the location of the first paddle 27 in the axial direction of the admix auger 23 is changed to a location in the first direction D1 from the first opening 26, an increase in apparatus size may be caused. Furthermore, if the location of the first paddle 27 in the axial direction of the admix auger 23 is changed to a location in the second direction D2 from the first opening 26, the amount of the developer inside the developing apparatus 20 may easily depend on a rotation speed of the admix auger 23 and thus may be unstable.

Figure 6:
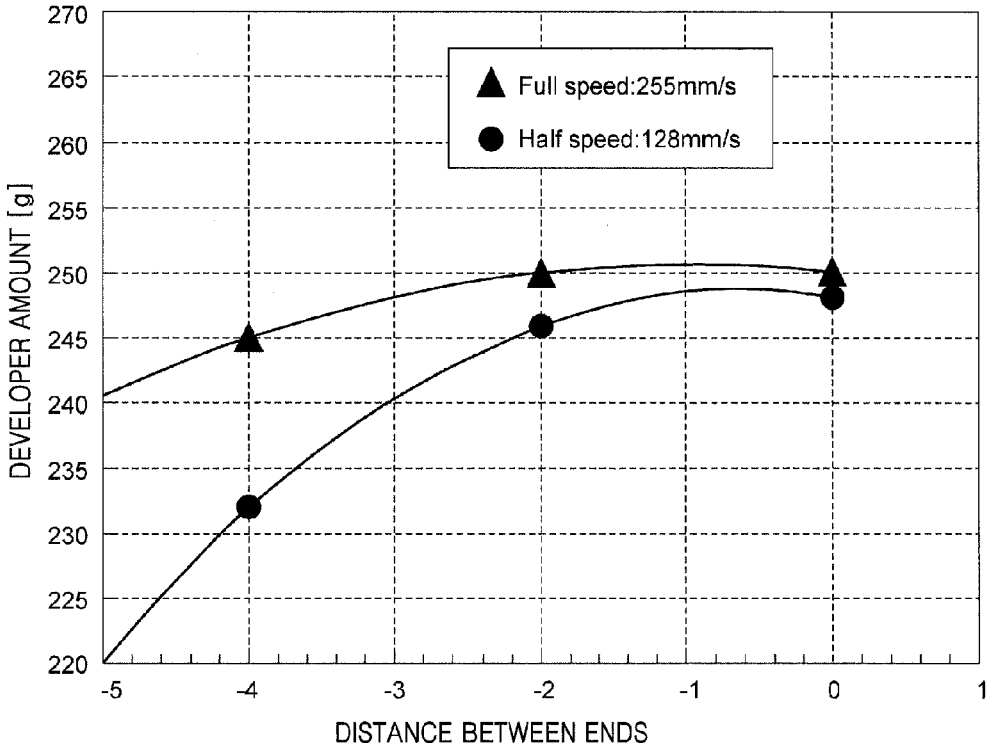
FIG. 6 is a graph showing the relation between the distance between ends and the amount of a developer.

Specifically, as illustrated in FIG. 6, if the location of the end 27A of the first paddle 27 is changed to a location in the second direction D2 (a negative direction) from the end 26A of the first opening 26, the amount of the developer inside the developing apparatus 20 easily varies based on variations in process speed. The horizontal axis of FIG. 6 shows relative locations of the end 27A of the first paddle 27 and the end 26A of the first opening 26. If the scale of the horizontal axis moves leftward, the distance between the end 27A of the first paddle 27 and the end 26A of the first opening 26 in the second direction D2 is increased. As shown in FIG. 6, the amount of the developer may be stabilized by providing the end 27A of the first paddle 27 and the end 26A of the first opening 26 at nearly equal locations in the axial direction (the location corresponding to about "0" in the horizontal axis of FIG. 6).

In addition, as illustrated in FIG. 4, the first paddle 27 extends in the axial direction of the admix auger 23 between two adjacent parts of the spiral blade 23B spirally protruding from the rotation shaft 23A of the admix auger 23, and the height of the first paddle 27 with respect to the rotation shaft 23A is nearly equal to the height of the spiral blade 23B with respect to the rotation shaft 23A. Herein, if the height of the first paddle 27 provided under the first opening 26 varies, the amount of the developer retained near the reverse spiral blade 22C varies based on the height of the first paddle 27 and thus the speed of discharging the developer over the reverse spiral blade 22C through the developer discharger 25 may be controlled.

However, for example, if the height of the first paddle 27 is greater than the height of the spiral blade 23B, the amount of the developer retained near the reverse spiral blade 22C is excessive, the developer discharge speed is much increased, and thus the developer is excessively discharged. Herein, if the height of the first paddle 27 is nearly equal to the height of the spiral blade 23B, excessive discharge of the developer may be suppressed, problems caused by a reduction in the amount of the developer inside the developing apparatus 20 may be prevented, and thus the image forming apparatus 1 may have a long life.

Figure 7:
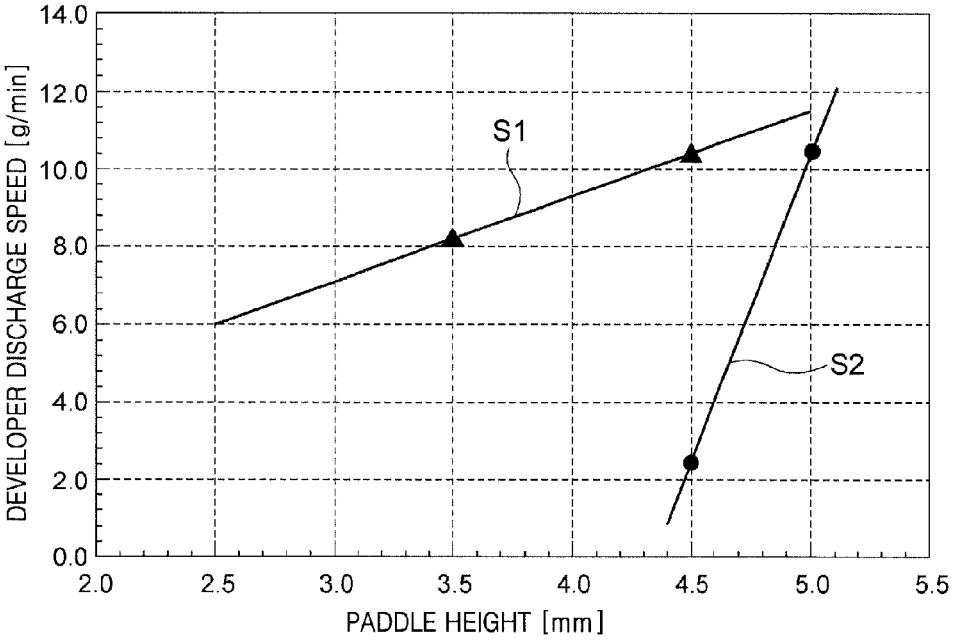
FIG. 7 is a graph showing the relation between the height of a paddle and a developer discharge speed.

Specifically, as shown in the graph of FIG. 7, if the relation between the height of the second paddle 28 (horizontal axis) and the developer discharge speed (vertical axis) when the height of the first paddle 27 is fixed to 5 mm is denoted by S1 and the relation between the height of the first paddle 27 (horizontal axis) and the developer discharge speed (vertical axis) when the height of the second paddle 28 is fixed to 4.5 mm is denoted by S2, the variations in the height of the first paddle 27 greatly influence the developer discharge speed as shown by the relation S2.

Even when the height of the second paddle 28 varies as shown by the relation S1, the second paddle 28 does not face the first opening 26 and thus influence thereof on the developer discharge speed is small. Thus, for example, if the height of the first paddle 27 is changed from 5.0 mm, which is equal to the height of the spiral blade 23B, to 4.5 mm, which is less than the height of the spiral blade 23B, the developer discharge speed is rapidly reduced as shown by the relation S2. Accordingly, the height of the first paddle 27 may be equal to or greater than the height of the spiral blade 23B.

Figure 8:
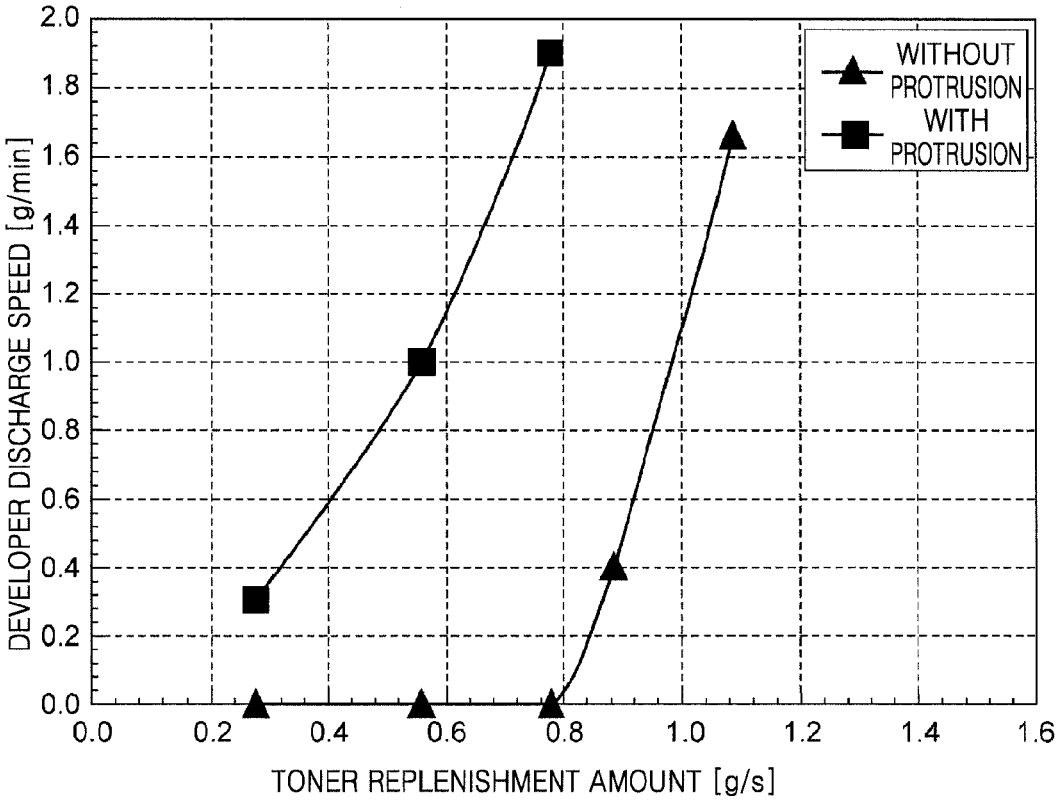
FIG. 8 is a graph showing the relation between a toner replenishment amount and a developer discharge speed.

FIG. 8 shows the developer discharge speed which is obtained when the amount of the developer inside the developing apparatus 20 is reduced by 10 g from a stable amount of the developer (e.g., 250 g), the toner is continuously replenished for 7 seconds through the developer replenisher 24, and then the supply auger 22 and the admix auger 23 are rotated for 30 seconds. As shown in FIG. 8, if the first paddle 27 protrudes from the spiral blade 23B in such a manner that the height of the first paddle 27 is greater than the height of the spiral blade 23B, the developer discharge speed with respect to the amount of the replenished toner is increased and thus the developer excessively discharged. Accordingly, the height of the first paddle 27 may be nearly equal to the height of the spiral blade 23B.

Figure 9:
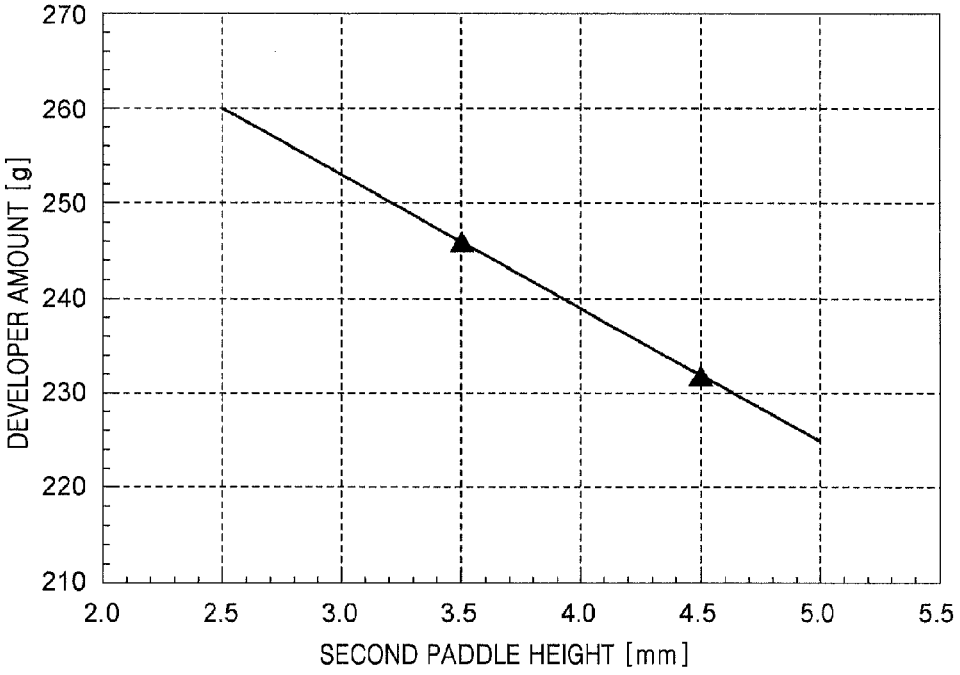
FIG. 9 is a graph showing the relation between the height of a second paddle and the amount of a developer.

As shown in FIG. 9, the height of the second paddle 28 is closely related to a stable amount of the developer inside the developing apparatus 20. This is involved in a developer flow control effect of the second paddle 28. Since problems such as auger marks or sensing errors easily occur due to variations in the amount of the developer inside the developing apparatus 20 employing the trickle development scheme, the amount of the developer inside the developing apparatus 20 should be controlled based on the height of the second paddle 28.

In addition, the spiral blade 23B spirally protruding from the rotation shaft 23A of the admix auger 23 is provided with a certain interval T (pitch) along the axial direction of the admix auger 23, and the second paddle 28 is provided at a location corresponding to 1.5 times of the interval T with respect to the location of the first paddle 27. As described above, by controlling the distance between the second paddle 28 and the first paddle 27 to 1.5 times of the interval T, an appropriate amount of the developer may be discharged. Furthermore, by providing the second paddle 28, the dependence of the amount of the developer inside the developing apparatus 20 on the rotation speed of the admix auger 23 may be reduced and thus the amount of the developer may be stabilized.

Figure 10:
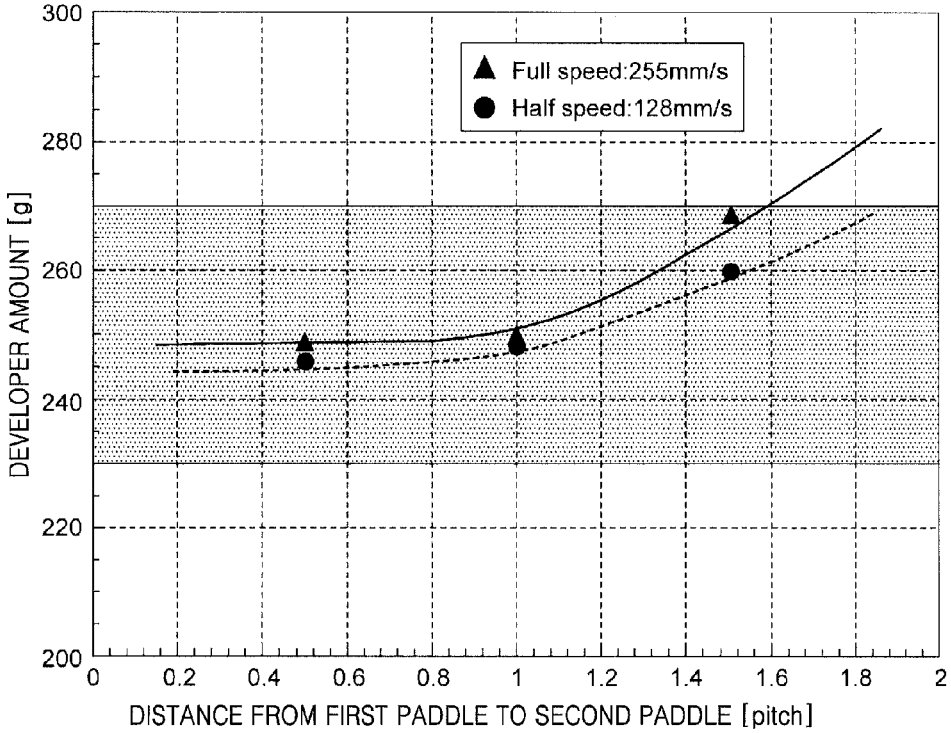
FIG. 10 is a graph showing the relation between the distance from a first paddle to a second paddle and the amount of a developer.

Specifically, as shown in FIG. 10, by controlling the distance from the first paddle 27 to the second paddle 28 within 1.5 pitches (within 1.5 times of the interval T), the amount of the developer inside the developing apparatus 20 may be within an allowable range (e.g., within a range equal to or greater than about 230 g and equal to or less than about 270 g). For example, the distance from the first paddle 27 to the second paddle 28 may be equal to or greater than 0.5 pitch and equal to or less than 1.5 pitches. Furthermore, as shown in FIG. 10, since the dependence of the amount of the developer on the rotation speed of the admix auger 23 is increased if the distance from the first paddle 27 to the second paddle 28 is increased, the distance from the first paddle 27 to the second paddle 28 is preferably short.

In addition, as illustrated in FIG. 2, the angle θ formed between the horizontal plane H1 and the straight line L for interconnecting the rotation center O1 of the supply auger 22 and the rotation center O2 of the admix auger 23 satisfies $45° \leq \theta \leq 90°$. Herein, if the angle θ between the straight line L and the horizontal plane H1 is less than 45°, the developer is easily retained by the first paddle 27 and thus a large amount of the developer is discharged by the first paddle 27. Otherwise, if the angle θ between the straight line L and the horizontal plane H1 is equal to or greater than 45° and equal to or less than 90°, the discharge amount of the developer may be appropriate and thus the amount of the developer inside the developing apparatus 20 may be stabilized.

Figure 11:
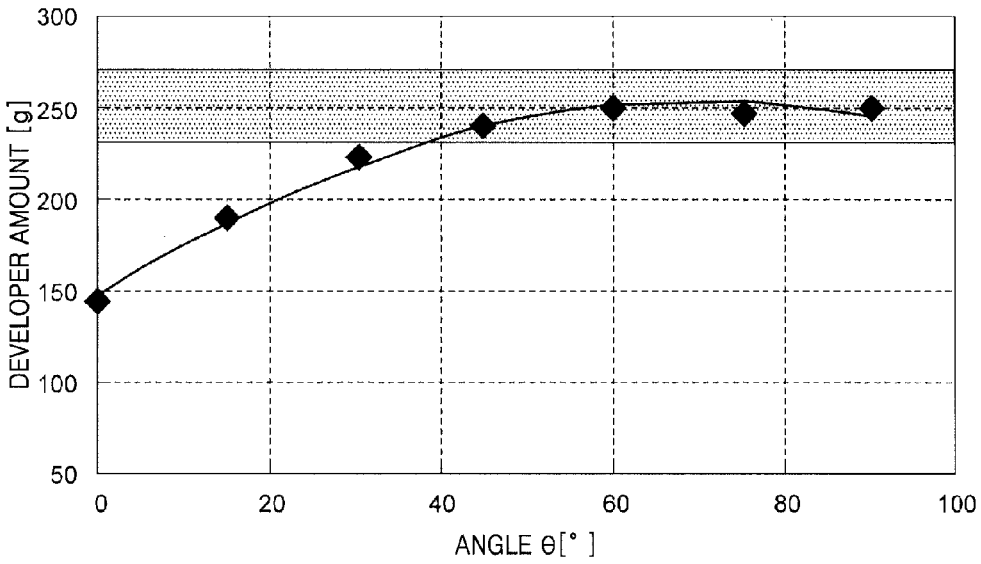
FIG. 11 is a graph showing the relation between the locations of two augers and the amount of a developer.

FIG. 11 shows the relation between the angle θ of the supply auger 22 and the admix auger 23 and the amount of the developer inside the developing apparatus 20. As shown in FIG. 11, if the angle θ is $45° \leq \theta \leq 90°$, the amount of the developer may be within an allowable range (e.g., within a range equal to or greater than about 230 g and equal to or less than about 270 g). However, if the angle θ is less than 45°, since a large amount of the developer is discharged by the first paddle 27, the amount of the developer is reduced below an allowable range. Accordingly, the angle θ may be controlled to $45° \leq \theta \leq 90°$ to maintain an appropriate amount of the developer.

Second Embodiment

Figure 12:
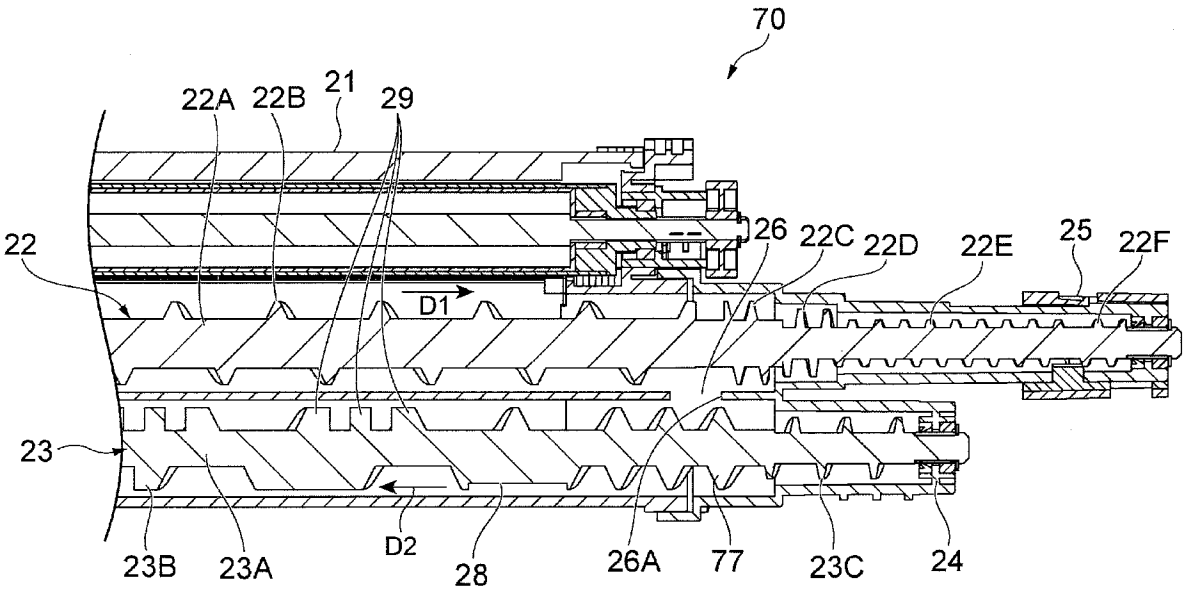
FIG. 12 is a cross-sectional view showing the vicinity of a developer discharger, according to a second embodiment.

As illustrated in FIG. 12, in a developing apparatus 70 according to the second embodiment, the configurations of a first retention means and a second retention means are different from those of the first embodiment. The plate-shaped first paddle 27 is employed as the first retention means in the first embodiment. A spiral blade 77 having a pitch less than that of the spiral blade 23B is employed instead of the first paddle 27 in the second embodiment. The pitch of the spiral blade 77 may be, for example, ½ to ⅓ of the pitch of the spiral blade 23B. Furthermore, in the first embodiment, the second paddle 28 is provided at a location corresponding to 1.5 pitches (a phase difference of 540°) in the second direction D2 from the first paddle 27. In the second embodiment, the second retention means (the second paddle 28) is provided at a location corresponding to 1.0 pitch in the second direction D2 from the first retention means (the spiral blade 77).

Even when the spiral blade 77 is used as the first retention means as in the second embodiment, the developer is lifted toward the supply auger 22 and thus a large amount of the developer does not enter the admix auger 23. Accordingly, the effect of the first embodiment may be equally achieved. Furthermore, since the spiral blade 77 is used as the first retention means in the second embodiment, the discharge amount of the developer may be adjusted by varying the pitch of the spiral blade 77.

Third Embodiment

Figure 13:
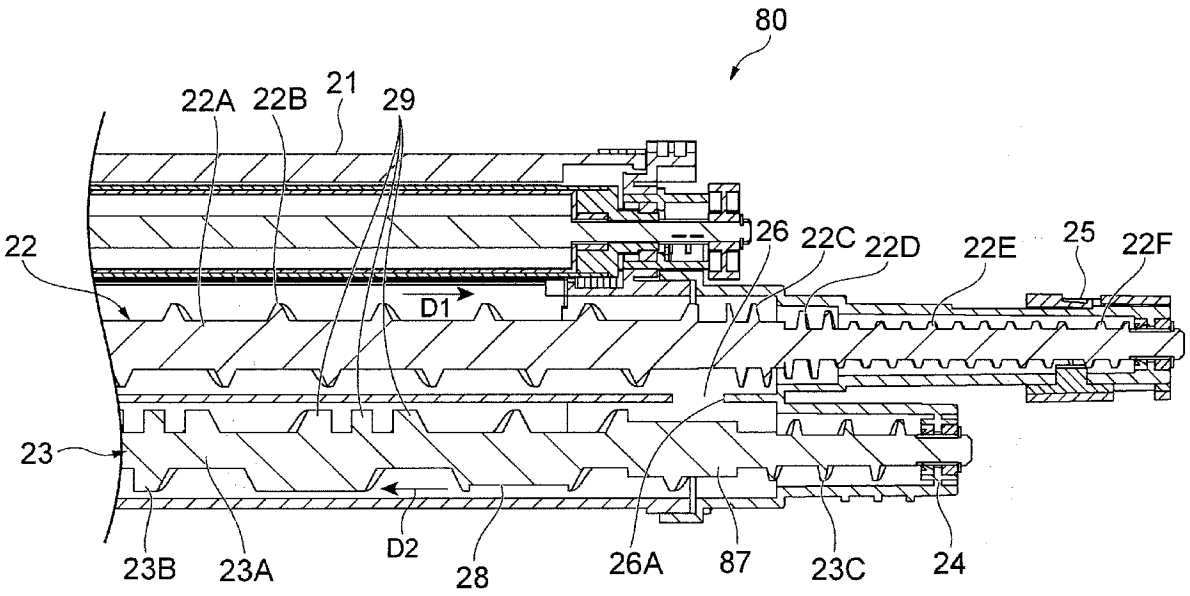
FIG. 13 is a cross-sectional view showing the vicinity of a developer discharger, according to a third embodiment.

As illustrated in FIG. 13, in a developing apparatus 80 according to the third embodiment, the configuration of a first retention means is different from that of the first embodiment. A diameter-enlarged part 87, the diameter of which is enlarged compared to that of the rotation shaft 23A, is employed instead of the first paddle 27 of the first embodiment in the third embodiment. The diameter of the diameter-enlarged part 87 may be, for example, 1.4 times of the diameter of the rotation shaft 23A. Even when the diameter-enlarged part 87 is used as the first retention means as in the third embodiment, the developer is lifted toward the supply auger 22 and thus a large amount of the developer does not enter the admix auger 23. Accordingly, the effect of the first embodiment may be equally achieved. Furthermore, since the diameter-enlarged part 87 is used as the first retention means in the third embodiment, the discharge amount of the developer may be adjusted by varying the diameter of the diameter-enlarged part 87.

In the above-described first to third embodiments, for example, the supply auger 22 includes the spiral blades 22B, 22D, and 22E and the reverse spiral blades 22C and 22F, but the configuration of the supply auger 22, e.g., the location or size of each blade, may appropriately vary.

In addition, although the admix auger 23 of the above-described embodiments includes the agitator 29, the agitator 29 may be omitted. Furthermore, although the admix auger 23 of the above-described embodiments includes the spiral blades 23B and 23C having different sizes, the configuration of the admix auger 23 is not limited thereto and may appropriately vary.

Besides, although the developer replenisher 24 is provided at one end of the admix auger 23 and the developer discharger 25 is provided at one end of the supply auger 22, the locations of the developer replenisher 24 and the developer discharger 25 are not limited to those described in the above embodiments and may appropriately vary.

Fourth Embodiment

A description is now given of an image forming apparatus 101 according to the fourth embodiment.

(Overall Configuration of Image Forming Apparatus)

Figure 14:
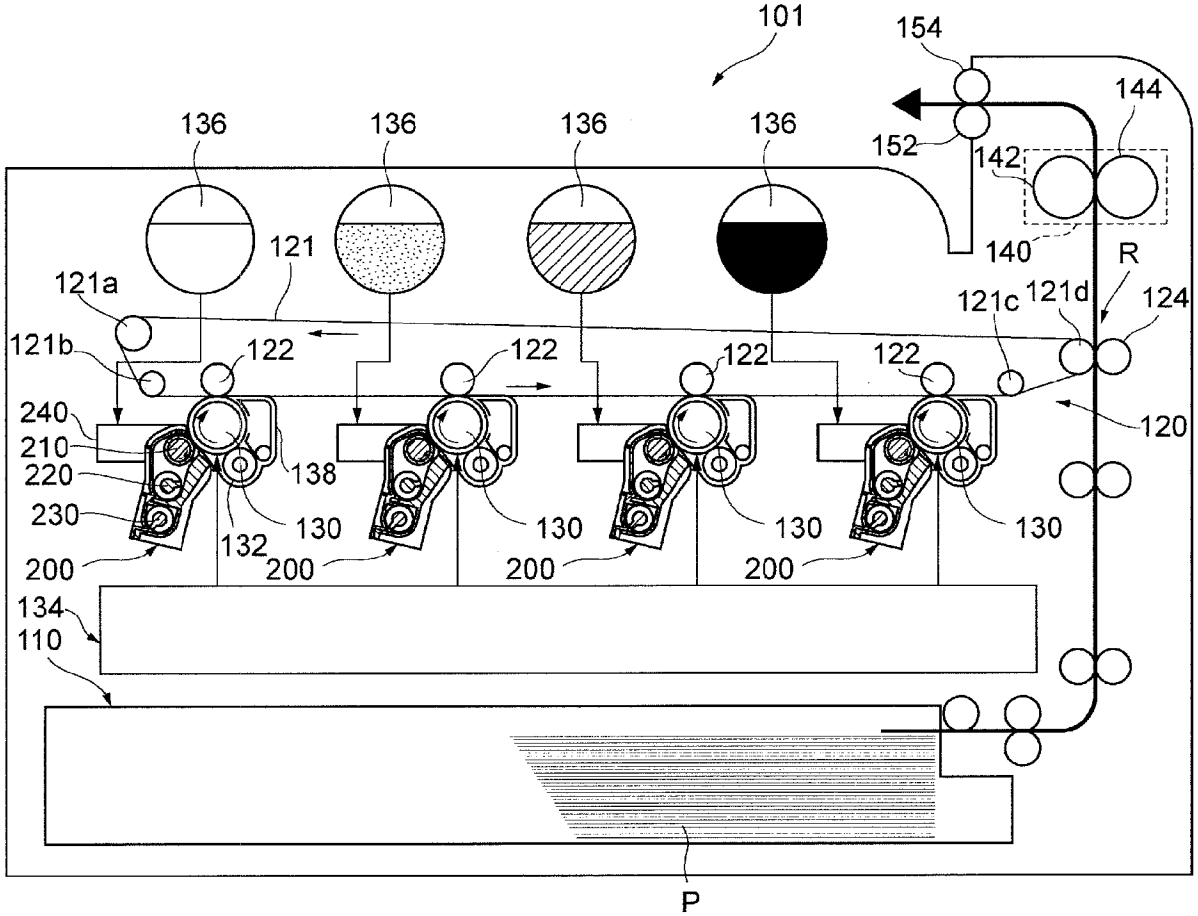
FIG. 14 is a structural view of an image forming apparatus according to a fourth embodiment.

As illustrated in FIG. 14, the image forming apparatus 101 includes a recording medium conveying unit 110, a transfer unit 120, photoreceptor drums 130, four developing units (developing apparatuses) 200, and a fixing unit 140.

The recording medium conveying unit 110 accommodates paper P as a recording medium for ultimately forming an image thereon and conveys the paper P along a recording medium route. The paper P is accommodated in a cassette in a stack. The recording medium conveying unit 110 conveys the paper P to a secondary transfer region R at a timing when toner images to be transferred onto the paper P reach the secondary transfer region R.

The transfer unit 120 conveys the toner images formed by the developing units 200 to the secondary transfer region R to secondarily transfer the toner images onto the paper P. The transfer unit 120 includes a transfer belt 121, suspending rollers 121*a*, 121*b*, 121*c*, and 121*d* for suspending the transfer belt 121, primary transfer rollers 122 facing the photoreceptor drums 130 by intervening the transfer belt 121 therebetween, and a secondary transfer roller 124 facing the suspending roller 121*d* by intervening the transfer belt 121 therebetween.

The transfer belt 121 is an endless belt which is circularly moved by the suspending rollers 121*a*, 121*b*, 121*c*, and 121*d*. The primary transfer rollers 122 press the photoreceptor drums 130 from an inner circumferential surface of the transfer belt 121. The secondary transfer roller 124 presses the suspending roller 121*d* from an outer circumferential surface of the transfer belt 121. The transfer unit 120 may further include, for example, a belt cleaning apparatus for removing the toners remaining on the transfer belt 121 after secondary transfer.

The photoreceptor drums 130 provide electrostatic latent images on circumferential surfaces thereof and may include, for example, an organic photoconductor (OPC). The image forming apparatus 101 according to the current embodiment is an apparatus capable of forming a color image and, for example, four photoreceptor drums 130 corresponding to magenta, yellow, cyan, and black are provided along a moving direction of the transfer belt 121. As illustrated in FIG. 14, a charging roller 132, an exposure unit 134, the developing unit 200, and a cleaning unit 138 are provided around each photoreceptor drum 130.

The charging roller 132 uniformly charges the surface of the photoreceptor drum 130 to a predetermined potential. The exposure unit 134 exposes the surface of the photoreceptor drum 130 charged by the charging roller 132 based on an image to be formed on the paper P. As such, the potential of a part of the surface of the photoreceptor drum 130 exposed by the exposure unit 134 varies and thus an electrostatic latent image is formed. Each of the four developing apparatuses 200 generates a toner image by developing the electrostatic latent image formed on the photoreceptor drum 130 using a toner supplied from a toner tank 136 provided to correspond to the developing apparatus 200. Replenishment developers including magenta, yellow, cyan, and black toners and carriers are individually filled in four toner tanks 136.

The cleaning unit 138 collects the toner remaining on the photoreceptor drum 130 after the toner image formed on the photoreceptor drum 130 is primarily transferred onto the transfer belt 121. The cleaning unit 138 may employ, for example, a scheme for removing the toner remaining on the photoreceptor drum 130 by putting a cleaning blade into contact with the circumferential surface of the photoreceptor drum 130. In addition, a charge eliminating lamp for resetting the potential of the photoreceptor drum 130 may be provided around the photoreceptor drum 130 between the cleaning unit 138 and the charging roller 132 based on a rotation direction of the photoreceptor drum 130.

The fixing unit 140 attaches and fixes the toner images secondarily transferred from the transfer belt 121 onto the paper P to the paper P. The fixing unit 140 includes, for example, a heating roller 142 and a pressing roller 144. The heating roller 142 is a cylindrical member capable of rotating about a rotation axis thereof and a heat source, e.g., a halogen lamp, is provided therein. The pressing roller 144 is a cylindrical member capable of rotating about a rotation axis thereof and is provided to press the heating roller 142. A heat-resistant elastic layer, e.g., silicon rubber, may be provided on outer circumferential surfaces of the heating roller 142 and the pressing roller 144. By passing the paper P through a fixing nip, which is a contact region between the heating roller 142 and the pressing roller 144, the toner images are melted and fixed to the paper P.

In addition, the image forming apparatus 101 includes discharge rollers 152 and 154 for discharging the paper P, to which the toner images are fixed by the fixing unit 140, out of the image forming apparatus 101.

A description is now given of operation of the image forming apparatus 101. When an image signal to be printed is input to the image forming apparatus 101, a controller (not shown) of the image forming apparatus 101 uniformly charges the surfaces of the photoreceptor drums 130 to a predetermined potential using the charging rollers 132, and then irradiates laser beams onto the surfaces of the photoreceptor drums 130 using the exposure unit 134 based on the input image signal to form electrostatic latent images.

The developing apparatus 200 controls the toner and a carrier to a desired mixing ratio. The developing apparatus 200 mixes and agitates the toner and the carrier to uniformly disperse the toner within a developer and thus achieves an optimal charge amount of the developer. The developer is provided to a developing roller 210. When the developer is conveyed to a region facing the photoreceptor drum 130 due to rotation of the developing roller 210, the toner of the developer provided to the developing roller 210 moves to the electrostatic latent image formed on the circumferential surface of the photoreceptor drum 130 and thus the electrostatic latent image is developed. The toner images formed as described above are primarily transferred from the photoreceptor drums 130 onto the transfer belt 121 in regions where the photoreceptor drums 130 and the transfer belt 121 face each other. The toner images transferred from the four photoreceptor drums 130 are sequentially stacked on the transfer belt 121 to form a single stacked toner image. The stacked toner image is secondarily transferred onto the paper P conveyed from the recording medium conveying unit 110 in the secondary transfer region R where the suspending roller 121*d* and the secondary transfer roller 124 face each other.

The paper P, onto which the stacked toner image is secondarily transferred, is conveyed to the fixing unit 140. By passing the paper P between the heating roller 142 and the pressing roller 144 with heat and pressure, the stacked toner image is melted and fixed to the paper P. Thereafter, the paper P is discharged out of the image forming apparatus 101 by discharge rollers 152 and 154. If a belt cleaning apparatus is provided, the toners remaining on the transfer belt 121 after the stacked toner image is secondarily transferred onto the paper P are removed by the belt cleaning apparatus.

(Configuration of Developing Unit)

Figure 15:
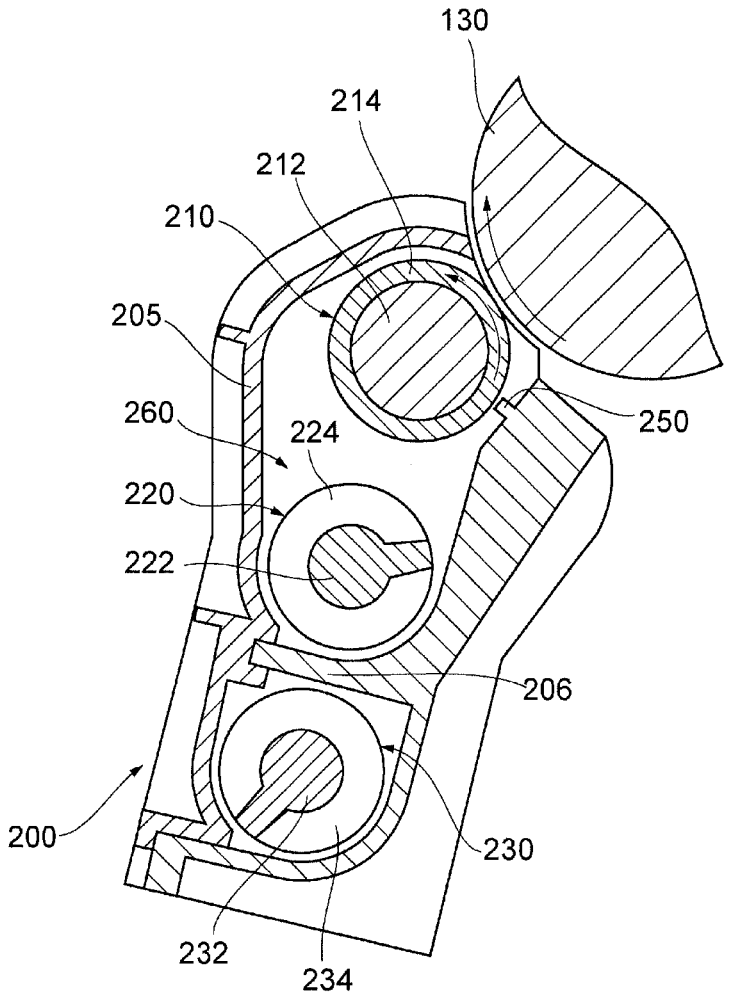
FIG. 15 is a vertical cross-sectional view of a developing unit of FIG. 14.

As illustrated in FIG. 15, the developing unit 200 includes the developing roller 210, a first agitating and conveying member (first auger) 220, and a second agitating and conveying member (second auger) 230. The developing roller 210, the first agitating and conveying member 220, and the second agitating and conveying member 230 are provided in a developer container 260 provided by a case 205 of the developing unit 200.

The developing roller 210 provides the toner to the electrostatic latent image formed on the circumferential surface of the photoreceptor drum 130. The developing roller 210 includes, for example, a developing sleeve 214 and a magnet 212 provided in the developing sleeve 214. The developing sleeve 214 is a tubular member formed of nonmagnetic metal. In the developing roller 210 of the current embodiment, only the developing sleeve 214 rotates and the magnet 212 provided in the developing sleeve 214 is fixed to the case 205 of the developing unit 200.

The magnet 212 includes a plurality of magnetic poles. For example, different magnetic poles are alternately provided from a region of the magnet 212 facing the photoreceptor drum 130 (i.e., a developing region for developing the electrostatic latent image formed on the photoreceptor drum 130) to a location facing the first agitating and conveying member 220 to convey the developer on the developing sleeve 214 using a magnetic force. Furthermore, a pole position or an inter-pole position is provided in the developing region to stand up bristles of a magnetic brush of the developer in the developing region such that the magnetic brush contacts or approaches the electrostatic latent image of the photoreceptor drum 130. Magnetic poles of the same polarity are provided adjacent to each other in a circumferential direction at a location where the developing roller 210 and the first agitating and conveying member 220 face each other. Due to the magnetic poles of the same polarity, tangential-direction and normal-direction magnetic forces with respect to a rotation direction of the developing sleeve 214 are small at the inter-pole position. As such, the developer is peeled off from the developing sleeve 214 due to rotation of the developing sleeve 214 at the location where the developing roller 210 and the first agitating and conveying member 220 face each other.

In addition, a layer thickness restriction member 250 is provided at an upstream side of the rotation direction of the developing sleeve 214 based on a location where the developing sleeve 214 of the developing roller 210 and the photoreceptor drum 130 face each other. The layer thickness restriction member 250 is a member for equalizing the thickness of the developer attached to the circumferential surface of the developing sleeve 214 to a uniform thickness and may employ, for example, a metal blade.

The first agitating and conveying member 220 and the second agitating and conveying member 230 agitate the magnetic carrier and the nonmagnetic toner included in the developer filled inside the developer container 260 to frictionally charge the carrier and the toner.

The first agitating and conveying member 220 is provided subvertically under the developing roller 210 to face the developing roller 210, and supplies the mixed and agitated developer to the developing roller 210. The first agitating and conveying member 220 includes a first support shaft (rotation shaft) 222 and a first conveying blade 224 (see FIG. 18). The first support shaft 222 is rotatably supported by the case 205 using a bearing. The first conveying blade 224 is provided on an outer circumferential surface of the first support shaft 222 and has a spiral slope provided along a length direction of the first support shaft 222. The first agitating and conveying member 220 conveys the developer, for example, in a first direction D1 (see FIG. 18).

The second agitating and conveying member 230 is provided subvertically under the first agitating and conveying member 220. The second agitating and conveying member 230 sufficiently charges the developer by mixing and agitating the developer, and supplies the charged developer to the first agitating and conveying member 220. Similarly to the first agitating and conveying member 220, the second agitating and conveying member 230 includes a second support shaft 232 and a second conveying blade 234. The second support shaft 232 is rotatably supported by the case 205 using a bearing. The second conveying blade 234 is provided on an outer circumferential surface of the second support shaft 232 and has a spiral slope provided along a length direction of the second support shaft 232. The second agitating and conveying member 230 conveys the developer, for example, in a second direction D2 (see FIG. 18) which is opposite to the first direction D1 (see FIG. 18).

The first agitating and conveying member 220 and the second agitating and conveying member 230 are provided side by side in such a manner that the first support shaft 222 and the second support shaft 232 are nearly parallel to each other. A partition 206 is provided between the first agitating and conveying member 220 and the second agitating and conveying member 230. The partition 206 is provided in such a manner that the first agitating and conveying member 220 and the second agitating and conveying member 230 are interconnected at two ends of the first and second agitating and conveying members 220 and 230.

The developer agitated and conveyed by the second agitating and conveying member 230 is agitated and conveyed by the first agitating and conveying member 220 to move to the circumferential surface of the developing roller 210. A toner density sensor (not shown) for detecting the density of the toner inside the developer container 260 is provided near the second agitating and conveying member 230. If the density of the toner inside the developer container 260 is lowered, a replenishment developer is supplied from the toner tank 136 into the developer container 260 through a developer supplier 240 (see FIG. 14).

The developing unit 200 of the current embodiment employs a trickle discharge scheme for discharging the developer deteriorated due to a printing operation from inside the developer container 260 by overflowing the developer through a trickle discharge port (developer discharge port) 280 (see FIGS. 16 and 17) provided on the case 205 using variations in the volume of the developer inside the developer container 260. A description is now given of the configuration for discharging the developer from the developer container 260 through the trickle discharge port 280.

(Trickle Discharge Port)

Figure 16:
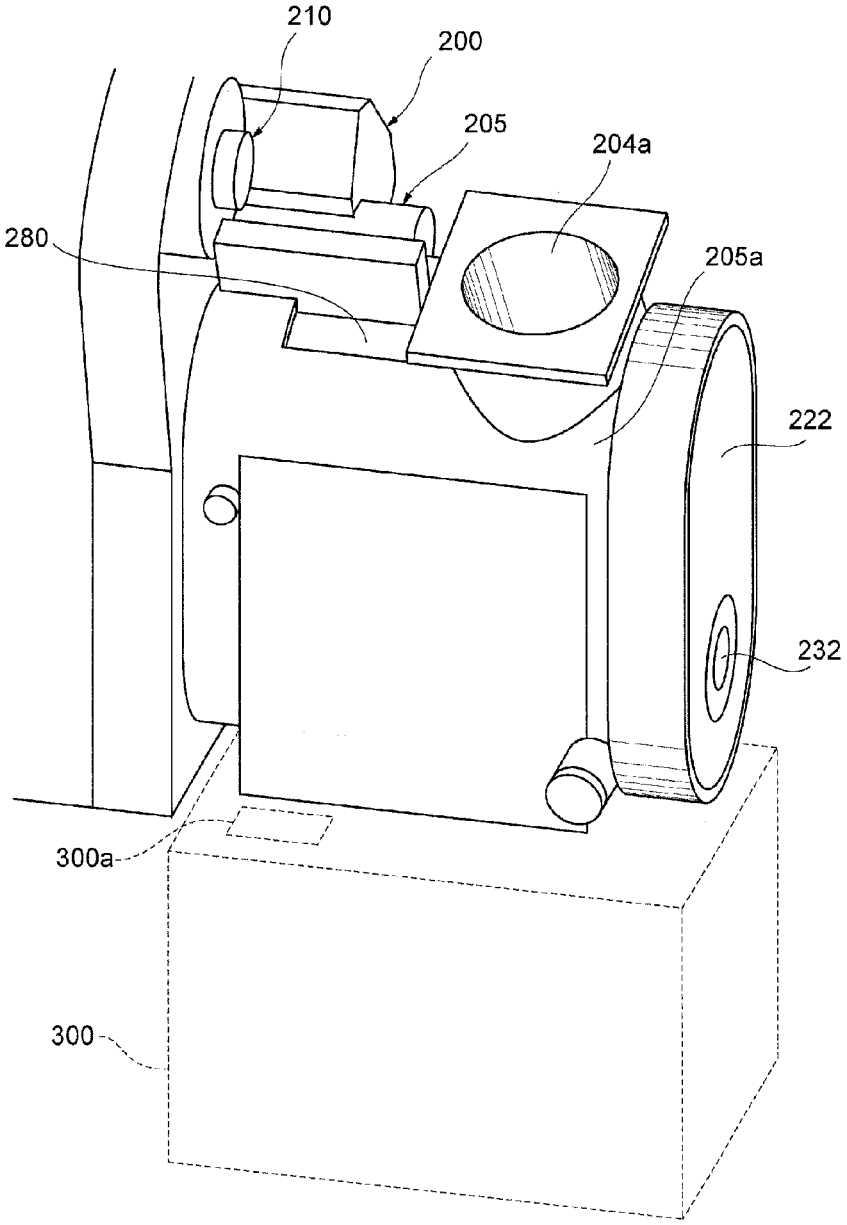
FIG. 16 is a perspective view showing the vicinity of a trickle discharge port of the developing unit of FIG. 14.

As illustrated in FIG. 16, the case 205 of the developing unit 200 includes a replenishment and discharge ports provider 205*a* located at one end thereof to support one end of the first support shaft 222 of the first agitating and conveying member 220 and one end of the second support shaft 232 of the second agitating and conveying member 230. The first agitating and conveying member 220 and the second agitating and conveying member 230 protrude more than the developing roller 210 at one end of the developing unit 200. The replenishment and discharge ports provider 205*a* surrounds ends of the first agitating and conveying member 220 and the second agitating and conveying member 230 protruding more than the developing roller 210. That is, at one end of the developing unit 200, the developer container 260 is provided by an inner surface of the replenishment and discharge ports provider 205*a* of the case 205.

A developer supply port 204*a* connected to the developer supplier 240 is provided at an upper side of the replenishment and discharge ports provider 205*a*. In addition, the trickle discharge port 280 is provided at an upper side of the replenishment and discharge ports provider 205*a* at an upstream side of a conveying direction of the developer compared to the developer supply port 204*a*. The trickle discharge port 280 is connected to the developer container 260 and the outside of the replenishment and discharge ports provider 205*a* and, as described above, is capable of discharging the developer from the developer container 260 in an overflow manner.

In the current embodiment, the developer discharged from the trickle discharge port 280 is conveyed to a waste developer container 300 provided at a predetermined location vertically under the trickle discharge port 280. As such, a cover 290 (see FIG. 19(*a*)) for providing a route for conveying the developer discharged from the trickle discharge port 280 to the waste developer container 300 is provided on an outer surface 250*a* of the replenishment and discharge ports provider 205*a*. The cover 290 is omitted in FIG. 16 to illustrate the trickle discharge port 280. The developer discharged from the trickle discharge port 280 passes between the cover 290 and the outer surface of the replenishment and discharge ports provider 205*a* and is conveyed into the waste developer container 300 through an opening 300*a* provided at an upper side of the waste developer container 300.

Figure 17:
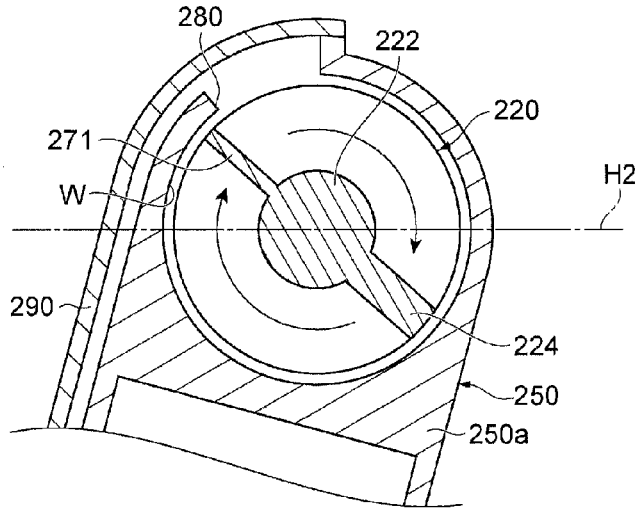
FIG. 17 is a vertical cross-sectional view of the vicinity of the trickle discharge port.

In addition, as illustrated in FIG. 17, the trickle discharge port 280 is provided in a wall W of the replenishment and discharge ports provider 205*a* for providing the developer container 260 at a location where the first conveying blade 224 moves from a lower side toward an upper side of the gravity direction when the first support shaft 222 of the first agitating and conveying member 220 rotates. Furthermore, the wall W has a tubular shape corresponding to the outer shape of the first agitating and conveying member 220 to surround the first agitating and conveying member 220. Besides, the first agitating and conveying member 220 rotates in a clockwise direction using the first support shaft 222 as a rotation axis thereof in FIG. 17. A lower end of the trickle discharge port 280 is located at an upper side of the gravity direction compared to a horizontal line H2 passing through a rotation center of the first support shaft 222.

(Configuration of First Agitating and Conveying Member)

Figure 18:
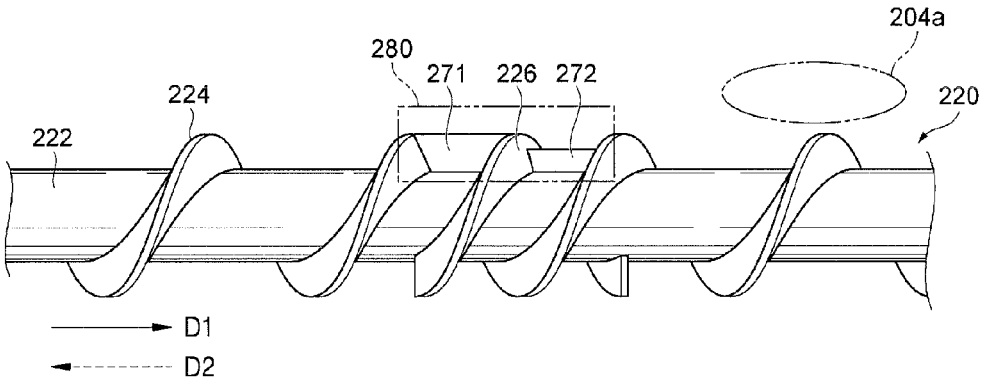
FIG. 18 is a view illustrating a first agitating and conveying member included in the developing unit.

A detailed description is now given of the configuration of the first agitating and conveying member 220. As illustrated in FIG. 18, an additional conveying blade 226 is provided at a part of the first agitating and conveying member 220 facing the trickle discharge port 280. The additional conveying blade 226 is provided on the outer circumferential surface of the first support shaft 222 and has a spiral slope inclined in the same direction as the first conveying blade 224. As such, the part of the first agitating and conveying member 220 facing the trickle discharge port 280 is wound by a larger number of blade loops compared to the other part. That is, a conveying blade pitch of the part of the first agitating and conveying member 220 facing the trickle discharge port 280 is less than that of the other part. The developer is conveyed from left to right (a direction from the trickle discharge port 280 toward the developer supply port 204*a*) in FIG. 18.

In addition, a first paddle (paddle member) 271 and a second paddle (paddle member) 272 are provided at a location of the first agitating and conveying member 220 facing the trickle discharge port 280. Each of the first paddle 271 and the second paddle 272 is provided between two adjacent parts of the conveying blade in an axial direction of the first support shaft 222. The first paddle 271 and the second paddle 272 are provided at different locations in the axial direction of the first support shaft 222. The first paddle 271 and the second paddle 272 are provided at the same location in a rotation direction of the first support shaft 222.

In more detail, the first paddle 271 is provided between the additional conveying blade 226 and the first conveying blade 224 located at an upstream side of a flowing direction of the developer (a left side in FIG. 18) from the additional conveying blade 226. The first paddle 271 is a plate-shaped member provided along a normal direction of the first support shaft 222. Two side ends of the first paddle 271 are individually connected to the first conveying blade 224 and the additional conveying blade 226, and an end of the first paddle 271 adjacent to the first support shaft 222 is connected to the outer circumferential surface of the first support shaft 222. The height of the first paddle 271, i.e., the height of the first paddle 271 from the center of the first support shaft 222, is equal to the height of the first conveying blade 224 from the center of the first support shaft 222.

The second paddle 272 is provided between the additional conveying blade 226 and the first conveying blade 224 located at a downstream side of the flowing direction of the developer (a right side in FIG. 18) from the additional conveying blade 226. The second paddle 272 is a plate-shaped member provided along the normal direction of the first support shaft 222. Two side ends of the second paddle 272 are individually connected to the first conveying blade 224 and the additional conveying blade 226, and an end of the second paddle 272 adjacent to the first support shaft 222 is connected to the outer circumferential surface of the first support shaft 222. The height of the second paddle 272, i.e., the height of the second paddle 272 from the center of the first support shaft 222, is less than the height of the first paddle 271 from the center of the first support shaft 222.

(Discharge of Developer from Trickle Discharge Port)

A description is now given of the configuration for discharging the developer from the trickle discharge port 280. Developer discharge characteristics of the first paddle 271 are different from the developer discharge characteristics of the second paddle 272. The following description is focused on the developer discharge characteristics of the first paddle 271 and the second paddle 272 in a case when a rotation speed of the first agitating and conveying member 220 is ⌈high⌋ and a case when the rotation speed of the first agitating and conveying member 220 is ⌈low⌋. Herein, the rotation speed of the first agitating and conveying member 220 is high if a process speed of the image forming apparatus 101 is high. An example of the case when the rotation speed of the first agitating and conveying member 220 is high includes a case when the process speed is increased by about three times compared to the case when the rotation speed of the first agitating and conveying member 220 is low.

Figure 19A:
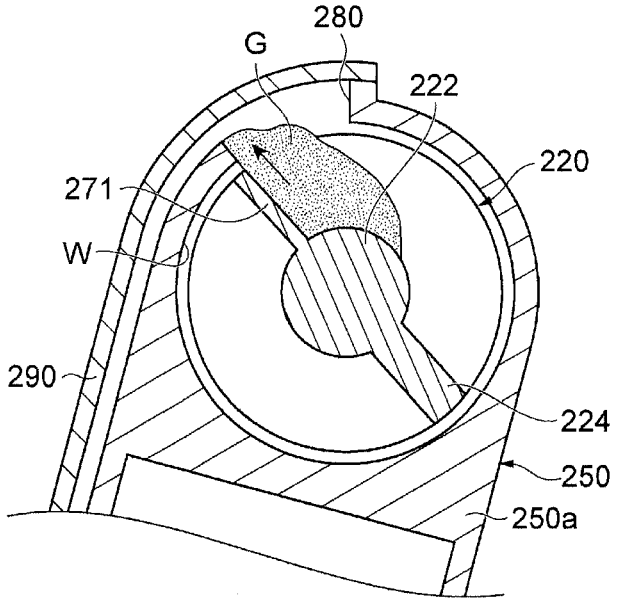
FIGS. 19A and 19B are vertical cross-sectional views of the vicinity of a first paddle and, more particularly.

A description is now given of the developer near the first paddle 271 in the case when the rotation speed of the first agitating and conveying member 220 is ⌈low⌋. As illustrated in FIG. 19A, when the first agitating and conveying member 220 rotates, a force is applied to a developer G by the first paddle 271. The developer G gradually moves in a direction away from the first support shaft 222 due to a centrifugal force when the force is applied by the first paddle 271. Since the height of the first paddle 271 is large and a gap between a front end of the first paddle 271 and the wall W is small, when the force is applied by the first paddle 271, the developer G is discharged out of the developer container 260 from the trickle discharge port 280 due to a centrifugal force.

Figure 20A:
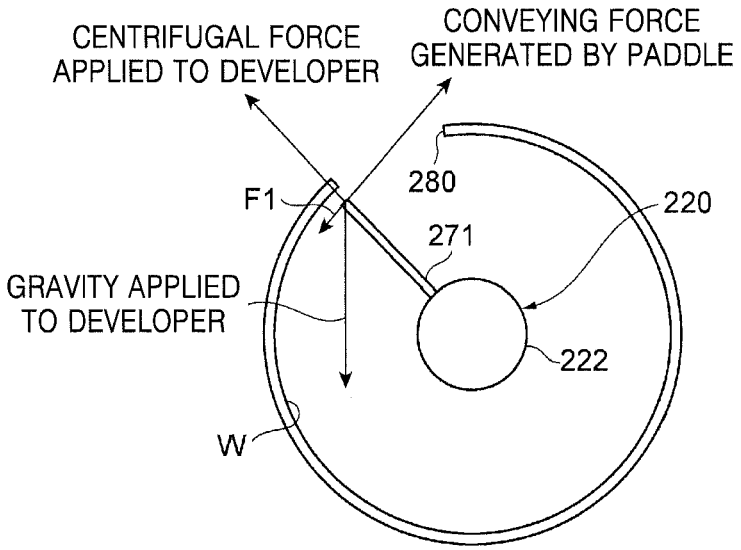
FIGS. 20A and 20B are schematic views showing forces applied to the developer and, more particularly.

Herein, a detailed description is given of the force applied to the developer G in the case when the rotation speed of the first agitating and conveying member 220 is low. As illustrated in FIG. 20A, when the front end of the first paddle 271 is located near the lower end of the trickle discharge port 280, a conveying force is applied to the developer G by the first paddle 271. When the conveying force is applied to the developer G by the first paddle 271, the developer G moves along the wall W while a moving direction thereof is restricted by the wall W. As such, the direction of the conveying force applied to the developer G by the first paddle 271 is a tangential direction of a circle generated due to rotation of the first paddle 271. The moment of inertia of the developer G in this case may be expressed as $\lceil mr^2\omega^2/2 \rfloor$. Herein, ⌈m⌋ denotes the weight of the developer G, ⌈r⌋ denotes a length from the rotation center of the first support shaft 222, and ⌈ω⌋ denotes an angular speed. A centrifugal force and gravity are applied to the developer G in addition to the conveying force. The centrifugal force may be expressed as $\lceil mr\omega^2 \rfloor$. Accordingly, a force F1 (a force considering the direction thereof) corresponding to a sum of the conveying force generated by the first paddle 271, the centrifugal force, and gravity is applied to the developer G. In the example illustrated in FIG. 20A, a force is applied to the developer G toward the first paddle 271, and the developer G piled up on the first paddle 271 is moved toward the trickle discharge port 280 due to a centrifugal force and is discharged through the trickle discharge port 280.

Figure 19B:
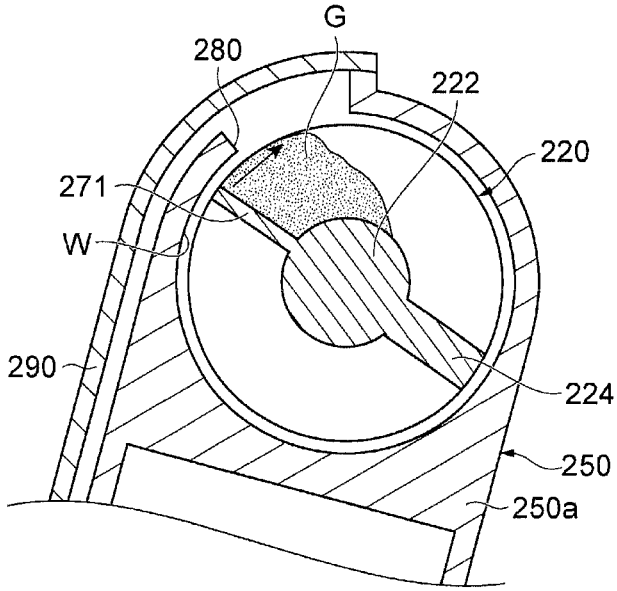

A description is now given of the developer near the first paddle 271 in the case when the rotation speed of the first agitating and conveying member 220 is ⌈high⌋. As illustrated in FIG. 19B, when the first agitating and conveying member 220 rotates, a force is applied to the developer G by the first paddle 271. Since the rotation speed of the first agitating and conveying member 220 is high, a conveying force is applied to the developer G by the first paddle 271. As such, although the trickle discharge port 280 is provided on the wall W, the developer G is not discharged through the trickle discharge port 280 but jumps over the trickle discharge port 280. As such, the amount of the developer G discharged through the trickle discharge port 280 in the case when the rotation speed of the first agitating and conveying member 220 is high is less than that in the case when the rotation speed of the first agitating and conveying member 220 is low.

Figure 20B:
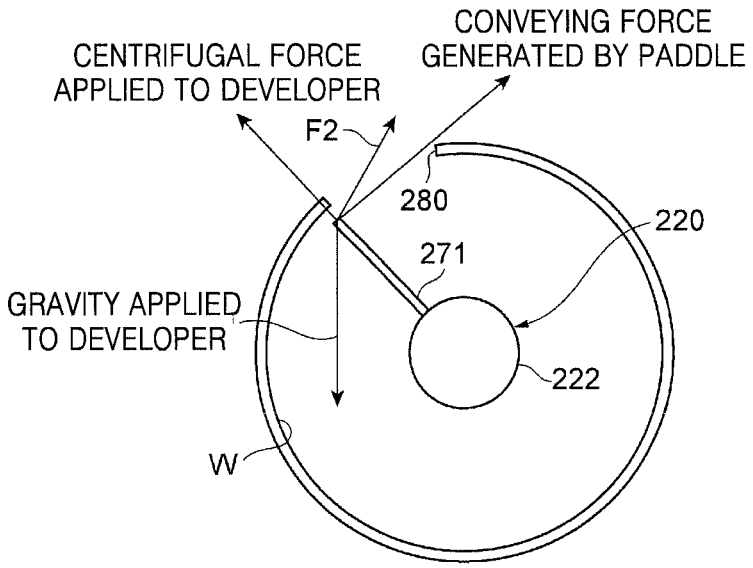

Herein, a detailed description is given of the force applied to the developer G in the case when the rotation speed of the first agitating and conveying member 220 is high. As illustrated in FIG. 20B, when the front end of the first paddle 271 is located near the lower end of the trickle discharge port 280, as described above, the conveying force generated by the first paddle 271, a centrifugal force, and gravity are applied to the developer G. Accordingly, a force F2 (a force considering the direction thereof) corresponding to a sum of the conveying force generated by the first paddle 271, the centrifugal force, and gravity is applied to the developer G. In the example illustrated in FIG. 20B, a force of a direction close to a tangential direction of a circle generated due to rotation of the second paddle 272 (the force F2) is applied to the developer G. As such, when the first paddle 271 rotates, the developer G moves along the wall W and jumps over the trickle discharge port 280 at a part where the trickle discharge port 280 is provided. In addition, since the trickle discharge port 280 is located above the rotation center of the first support shaft 222, the developer G moves along the wall W near the lower end of the trickle discharge port 280 while a moving direction thereof is restricted by the wall W. Accordingly, the developer G returns to the inside and thus discharge of the developer G from the trickle discharge port 280 is suppressed.

Figure 21A:
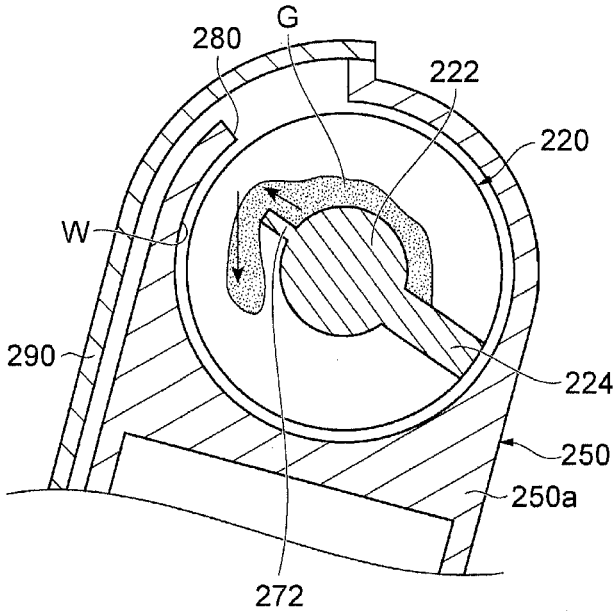
FIGS. 21A and 21B are vertical cross-sectional views of the vicinity of a second paddle and, more particularly.

A description is now given of the developer near the second paddle 272 in the case when the rotation speed of the first agitating and conveying member 220 is ⌈low⌋. As illustrated in FIG. 21A, when the first agitating and conveying member 220 rotates, a force is applied to the developer G by the second paddle 272. Herein, the height of the second paddle 272 is less than the height of the first paddle 271. If the height of a paddle, e.g., the second paddle 272, is reduced, the above-described moment of inertia is reduced by applying the square of ⌈r⌋ and thus a centrifugal force is relatively strongly applied to a developer compared to a conveying force. As such, the developer G may easily move in a direction away from the first support shaft 222. However, since the gap between the wall W and a front end of the second paddle 272 is large, the developer G drops downward. As such, when the rotation speed of the first agitating and conveying member 220 low, although the force is applied to the developer G by the second paddle 272, the developer G is not or hardly discharged through the trickle discharge port 280.

Figure 21B:
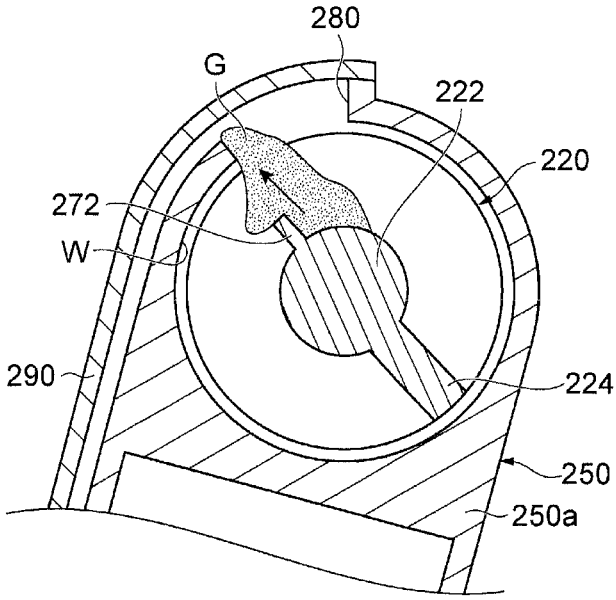

A description is now given of the developer near the second paddle 272 in the case when the rotation speed of the first agitating and conveying member 220 is ⌈high⌋. As illustrated in FIG. 21B, when the first agitating and conveying member 220 rotates, a force is applied to the developer G by the second paddle 272. As described above, if the height of a paddle is reduced, a centrifugal force is relatively strongly applied to a developer compared to a conveying force. In addition, since the rotation speed of the first agitating and conveying member 220 is high, a large centrifugal force is applied to the developer G compared to the case when the rotation speed of the first agitating and conveying member 220 is low, which is illustrated in FIG. 21A. As such, when the force is applied by the second paddle 272, the developer G flies to the trickle discharge port 280 due to the centrifugal force and is discharged through the trickle discharge port 280.

A description is now given of a result of measuring the speed of discharging the developer G from the trickle discharge port 280 by varying the height of a paddle provided on the first support shaft 222. For example, as shown by a line indicated with black diamonds (◆) in FIG. 22, when the rotation speed of the first agitating and conveying member 220 is high, the developer G is hardly discharged from the trickle discharge port 280 if the height of the paddle is from 0 mm to 3.5 mm. If the height of the paddle is greater than 3.5 mm, the amount of the developer G discharged from the trickle discharge port 280 is increased. Meanwhile, as shown by a line indicated with black squares (■) in FIG. 22, when the rotation speed of the first agitating and conveying member 220 is low, the developer G is hardly discharged until the height of the paddle reaches 2 mm. However, if the height of the paddle is greater than 2 mm, the speed of discharging the developer G from the trickle discharge port 280 is rapidly increased. The speed of discharging the developer G is the highest if the height of the paddle is about 3 mm, and is rapidly reduced after the height of the paddle exceeds 3 mm.

The case when the rotation speed of the first agitating and conveying member 220 is high includes a case when the process speed (print speed) of the image forming apparatus 101 is, for example, 300 mm/sec. The case when the rotation speed of the first agitating and conveying member 220 is low includes a case when the process speed of the image forming apparatus 101 is, for example, 100 mm/sec.

As described above, the height of the paddle capable of achieving the highest speed of discharging the developer G in the case when the first agitating and conveying member 220 rotates fast differs from that in the case when the first agitating and conveying member 220 rotates slowly. That is, when the rotation speed of the first agitating and conveying member 220 is high, the speed of discharging the developer G is high if the height of the paddle is large. Meanwhile, when the rotation speed of the first agitating and conveying member 220 low, the speed of discharging the developer G is the highest if the height of the paddle is less than the height of the paddle capable of increasing the discharge speed in the case when the rotation speed of the first agitating and conveying member 220 is high.

Figures 22, 23:
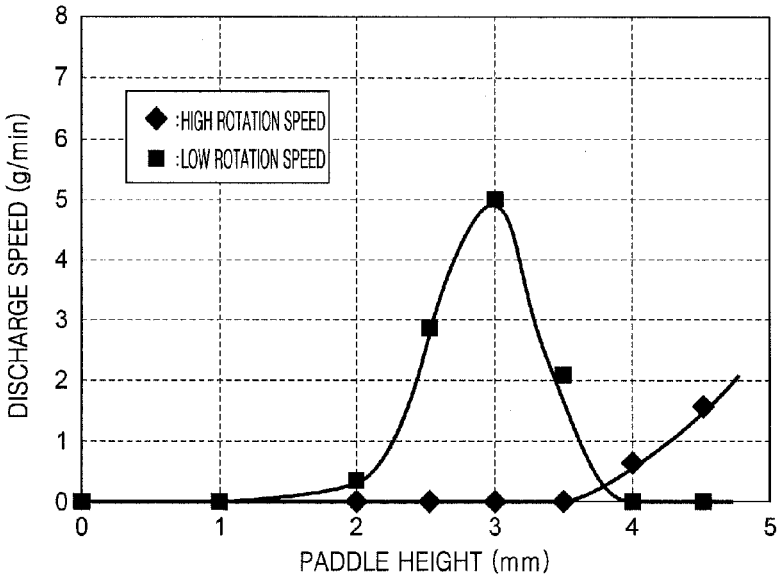
FIG. 22 is a graph showing a result of measuring the speed of discharging the developer from the trickle discharge port by varying the height of a paddle.
FIG. 23 is a table showing a result of measuring the amount of the developer filled inside a developer container in a case when the rotation speed of the first agitating and conveying member varies.

A description is now given of a result of measuring the amount (stable amount) of the developer filled inside the developer container 260 in a case when the height of the first paddle 271 is 4.5 mm, the height of the second paddle 272 is 3 mm, and the rotation speed of the first agitating and conveying member 220 varies, with reference to FIG. 23. In FIG. 23, a target amount of the developer inside the developer container 260 is 220 g. If each element of the developing apparatus 200 is configured in such a manner that the amount of the developer inside the developer container 260 is 220 g when the rotation speed of the first agitating and conveying member 220 is high (when the process speed is high, e.g., 300 mm/sec.), the amount of the developer when the rotation speed of the first agitating and conveying member 220 is low (when the process speed is low, e.g., 100 mm/sec.) is 245 g.

Meanwhile, only a first agitating and conveying member not including the additional conveying blade 226, the first paddle 271, and the second paddle 272, and a paddle are used and configured in such a manner that the amount of the developer is 220 g when a rotation speed of the first agitating and conveying member is high, the amount of the developer is 280 g when the rotation speed of the first agitating and conveying member is low. As described above, by providing the first paddle 271, etc., even when the rotation speed of the first agitating and conveying member 220 low, improvement of 35 g may be achieved with respect to 220 g of the target amount of the developer compared to the case when the first paddle 271, etc. are not provided.

In the developing unit 200 of the current embodiment, the number of blade loops at the location of the first agitating and conveying member 220 facing the trickle discharge port 280 is increased by providing the additional conveying blade 226 thereon. As such, the first paddle 271 and the second paddle 272 may be provided at the location facing the trickle discharge port 280 without increasing an axial-direction length of the first agitating and conveying member 220. Furthermore, since a plurality of paddles may be provided at the location facing the trickle discharge port 280, the first paddle 271 and the second paddle 272 having different developer discharge characteristics may be provided at the location facing the trickle discharge port 280. That is, a plurality of paddles capable of discharging different amounts of the developer based on the rotation speed of the first agitating and conveying member 220 may be provided. As such, even when the process speed of the image forming apparatus 101 varies and thus the rotation speed of the first agitating and conveying member 220 varies, a desired amount of the developer may be discharged from the trickle discharge port 280. Accordingly, even when the process speed of the developing unit 200 varies, a stable amount of the developer inside the developer container 260 may be maintained.

In addition, conveyance non-uniformity of the developer by the first agitating and conveying member 220 may easily vary based on the process speed of the image forming apparatus 101. If the developer having conveyance non-uniformity is conveyed to the part of the first agitating and conveying member 220 on which the additional conveying blade 226 is provided, a large number of blade loops receive the developer having conveyance non-uniformity. As such, the height of the developer differs among the blade loops. In this case, since the first paddle 271 and the second paddle 272 may be provided at different axial-direction locations of the first support shaft 222 of the first agitating and conveying member 220, the first paddle 271 and the second paddle 272 may be provided to correspond to the different heights of the developer. Accordingly, even when conveyance non-uniformity varies, a stable amount of the developer inside the developer container 260 may be maintained.

The trickle discharge port 280 is provided in the wall W of the developer container 260 at a location where the first conveying blade 224 moves from a lower side toward an upper side of the gravity direction when the first agitating and conveying member 220 rotates. For example, if the trickle discharge port 280 is provided in the wall W at a location where the first conveying blade 224 moves from an upper side toward a lower side of the gravity direction, the developer is discharged through the trickle discharge port 280 not due to rotation of the first paddle 271 and the second paddle 272 but due to great influence of gravity drop. As such, by providing the trickle discharge port 280 in the wall W at a location where the first conveying blade 224 moves from a lower side toward an upper side of the gravity direction, the developer may be discharged due to rotation of the first paddle 271 and the second paddle 272. That is, discharge of the developer may be effectively controlled by the first paddle 271 and the second paddle 272.

By providing the first paddle 271 and the second paddle 272 with different heights, a centrifugal force and a conveying force (a force in a rotation direction of the paddles) applied to the developer conveyed near the paddles may be changed. Accordingly, by switching the heights of the first paddle 271 and the second paddle 272, paddles having desired discharge performance based on the rotation speed of the first agitating and conveying member 220 may be easily configured.

By providing the first paddle 271 and the second paddle 272 at the same location in the rotation direction of the first support shaft 222, the first paddle 271 and the second paddle 272 having different heights may retrain the same amount of the developer. As such, the heights of the first paddle 271 and the second paddle 272 for achieving desired discharge performance may be easily configured.

The lower end of the trickle discharge port 280 is located at an upper side of the gravity direction compared to the rotation center of the first support shaft 222. For example, if the lower end of the trickle discharge port 280 is located at a lower side of the gravity direction compared to the rotation center of the first support shaft 222, the developer is easily discharged through the trickle discharge port 280 due to an increase in the volume of the developer or influence of gravity drop of the developer conveyed by the first agitating and conveying member 220. As such, by locating the lower end of the trickle discharge port 280 at an upper side of the gravity direction compared to the rotation center of the first support shaft 222, the developer may be discharged not due to an increase in the volume of the developer or gravity drop of the developer but due to rotation of the first paddle 271 and the second paddle 272. That is, discharge of the developer may be effectively controlled by the first paddle 271 and the second paddle 272.

In the above-described fourth embodiment, for example, the end of the first paddle 271 adjacent to the first support shaft 222 is connected to the outer circumferential surface of the first support shaft 222, but a gap may be present between the first paddle 271 and the outer circumferential surface of the first support shaft 222. Likewise, a gap may be present between the outer circumferential surface of the first support shaft 222 and the second paddle 272.

Holes may be provided in the first paddle 271 and the second paddle 272. In this case, the amount of the developer G discharged through the trickle discharge port 280 may be adjusted using the holes provided in the first paddle 271, etc.

Although two paddles (the first paddle 271 and the second paddle 272) are provided at the location of the first agitating and conveying member 220 facing the trickle discharge port 280 in the fourth embodiment, a larger number of blade loops may be provided and three or more paddles may be provided in the axial direction of the first support shaft 222. In this case, the discharge amount of the developer G may be more precisely controlled based on the rotation speed of the first agitating and conveying member 220.

Furthermore, although the number of blade loops is increased by providing the additional conveying blade 226 at the location of the first agitating and conveying member 220 facing the trickle discharge port 280 in the fourth embodiment, the number of blade loops may also be increased at the part facing the trickle discharge port 280 by reducing the interval between two adjacent parts of the first conveying blade 224 (in the axial direction of the first support shaft 222).

Besides, the tandem-type image forming apparatus 101 illustrated in FIG. 14 is an example of image forming apparatuses using the developing unit 200 according to the fourth embodiment, and the developing unit 200 according to the fourth embodiment is applicable to various types of image forming apparatuses. Furthermore, the configuration of the developing unit 200 is not limited to that described in the fourth embodiment and the present invention is applicable to various types of developing units employing a trickle discharge scheme.

In addition, the image forming apparatus 101 according to the fourth embodiment may or may not have the features of any one of the above-described first to third embodiments.

Fifth Embodiment

Figure 24:
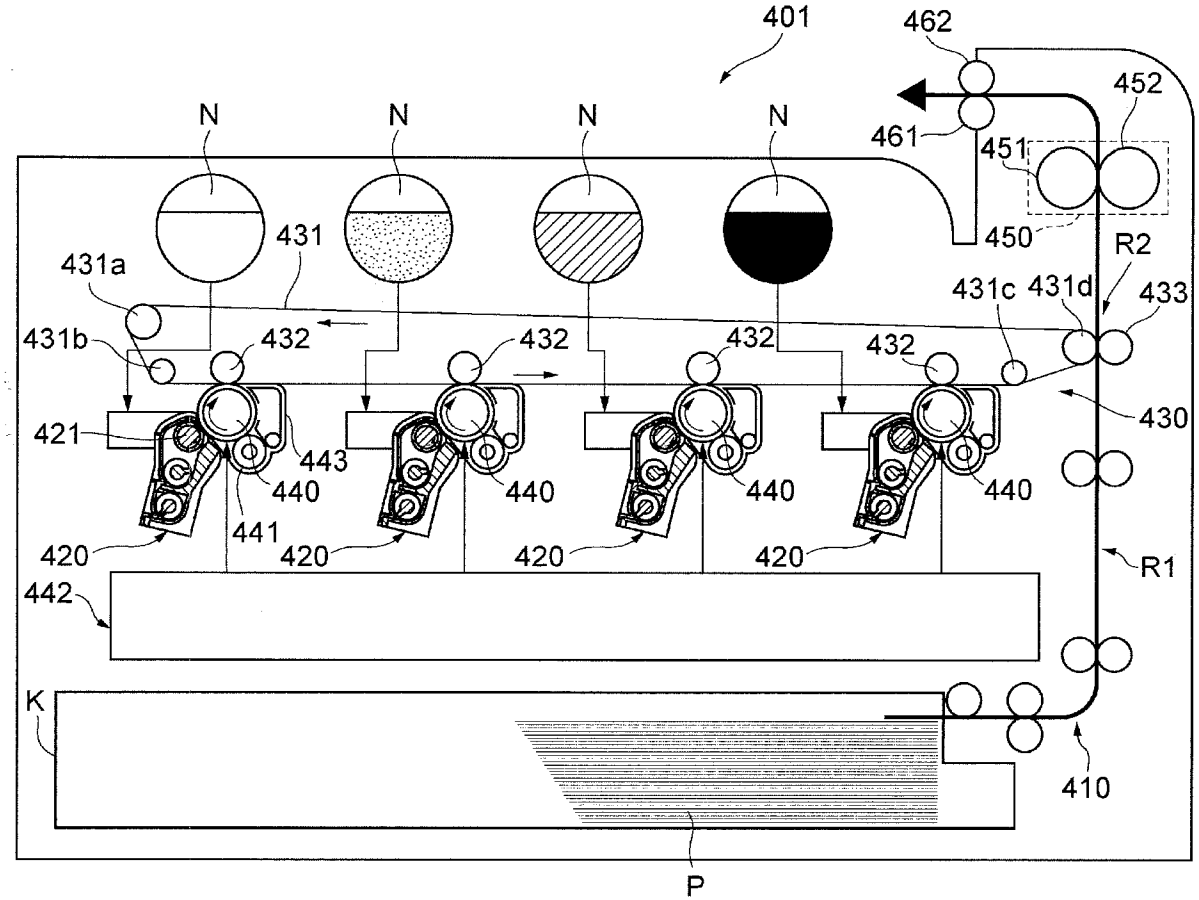
FIG. 24 is a structural view of an image forming apparatus including developing apparatuses, according to a fifth embodiment.

As illustrated in FIG. 24, an image forming apparatus 401 according to the fifth embodiment is an apparatus for forming a color image using magenta, yellow, cyan, and black. The image forming apparatus 401 includes a recording medium conveying unit 410 for conveying paper P, developing apparatuses 420 for developing electrostatic latent images, a transfer unit 430 for secondarily transferring toner images onto the paper P, photoreceptor drums 440 for providing the electrostatic latent images on circumferential surfaces thereof, and a fixing unit 450 for fixing the toner images to the paper P.

The recording medium conveying unit 410 conveys the paper P serving as a recording medium for forming an image thereon along a route R1. The paper P is accommodated in a cassette K in a stack. The recording medium conveying unit 410 conveys the paper P along the route R1 to a secondary transfer region R2 at a timing when the toner images to be transferred onto the paper P reach the secondary transfer region R2.

Four developing apparatuses 420 are provided to respectively correspond to the four colors. Each developing apparatus 420 includes a developing roller 421 for providing a toner to the photoreceptor drum 440. The developing apparatus 420 controls the toner and a carrier to a desired mixing ratio. The developing apparatus 420 mixes and agitates the toner and the carrier to uniformly disperse the toner within a developer and thus achieves an optimal charge amount of the developer. The developer is provided to the developing roller 421. When the developer is conveyed to a region facing the photoreceptor drum 440 due to rotation of the developing roller 421, the toner of the developer provided to the developing roller 421 moves to the electrostatic latent image formed on the circumferential surface of the photoreceptor drum 440 and thus the electrostatic latent image is developed. In addition, to maintain the charge amount of the developer filled inside the developing apparatus 420 constant, a trickle development scheme for discharging the deteriorated developer and replenishing a fresh developer by the amount of the discharged developer is employed. The deteriorated developer is accommodated in a waste toner collecting apparatus (not shown).

The transfer unit 430 conveys the toner images formed by the developing apparatuses 420 to the secondary transfer region R2 to secondarily transfer the toner images onto the paper P. The transfer unit 430 includes a transfer belt 431, suspending rollers 431*a*, 431*b*, 431*c*, and 431*d* for suspending the transfer belt 431, primary transfer rollers 432 facing the photoreceptor drums 440 by intervening the transfer belt 431 therebetween, and a secondary transfer roller 433 facing the suspending roller 431*d* by intervening the transfer belt 431 therebetween.

The transfer belt 431 is an endless belt which is circularly moved by the suspending rollers 431*a*, 431*b*, 431*c*, and 431*d*. The primary transfer rollers 432 are provided to press the photoreceptor drums 440 from an inner circumferential surface of the transfer belt 431. The secondary transfer roller 433 is provided to press the suspending roller 431*d* from an outer circumferential surface of the transfer belt 431.

Four photoreceptor drums 440 are provided to respectively correspond to the four colors. The photoreceptor drums 440 are provided along a moving direction of the transfer belt 431. The developing apparatus 420, a charging roller 441, an exposure unit 442, and a cleaning unit 443 are provided around each photoreceptor drum 440.

The charging roller 441 uniformly charges the surface of the photoreceptor drum 440 to a predetermined potential. The exposure unit 442 exposes the surface of the photoreceptor drum 440 charged by the charging roller 441 based on image information to be formed on the paper P. As such, the potential of a part of the surface of the photoreceptor drum 440 exposed by the exposure unit 442 is changed and thus an electrostatic latent image is formed. Each of the four developing apparatuses 420 generates a toner image by developing the electrostatic latent image formed on the photoreceptor drum 440 using a toner supplied from a toner tank N facing the developing apparatus 420. Magenta, yellow, cyan, and black toners are individually filled in the toner tanks N. The cleaning unit 443 collects the toner remaining on the photoreceptor drum 440 after primary transfer.

The fixing unit 450 attaches and fixes the toner images secondarily transferred from the transfer belt 31 onto the paper P to the paper P. The fixing unit 450 includes a heating roller 451 for heating the paper P, and a pressing roller 452 for pressing the heating roller 451. The heating roller 451 and the pressing roller 452 have cylindrical shapes and a heat source such as a halogen lamp is located in the heating roller 451. A fixing nip, which is a contact region, is generated between the heating roller 451 and the pressing roller 452. By passing the paper P through the fixing nip, the toner images are melted and fixed to the paper P.

In addition, the image forming apparatus 401 includes discharge rollers 461 and 462 for discharging the paper P, to which the toner images are fixed by the fixing unit 450, out of the image forming apparatus 401.

A description is now given of operation of the image forming apparatus 401. When an image signal to be printed is input to the image forming apparatus 401, a controller of the image forming apparatus 401 uniformly charges the surfaces of the photoreceptor drums 440 to a predetermined potential using the charging rollers 441, and then irradiates laser beams onto the surfaces of the photoreceptor drums 440 using the exposure unit 442 based on the input image signal to form electrostatic latent images.

The developing apparatuses 420 form toner images by developing the electrostatic latent images. The toner images formed as described above are primarily transferred from the photoreceptor drums 440 onto the transfer belt 431 in regions where the photoreceptor drums 40 and the transfer belt 431 face each other. The toner images transferred from the four photoreceptor drums 440 are sequentially stacked on the transfer belt 431 to form a single stacked toner image. The stacked toner image is secondarily transferred onto the paper P conveyed from the recording medium conveying unit 410 in the secondary transfer region R2 where the suspending roller 431*d* and the secondary transfer roller 433 face each other.

The paper P, onto which the stacked toner image is secondarily transferred, is conveyed to the fixing unit 450. By passing the paper P between the heating roller 451 and the pressing roller 452 with heat and pressure, the stacked toner image is melted and fixed to the paper P. Thereafter, the paper P is discharged out of the image forming apparatus 401 by the discharge rollers 461 and 462.

A detailed description is now given of the developing apparatus 420.

Figure 25:
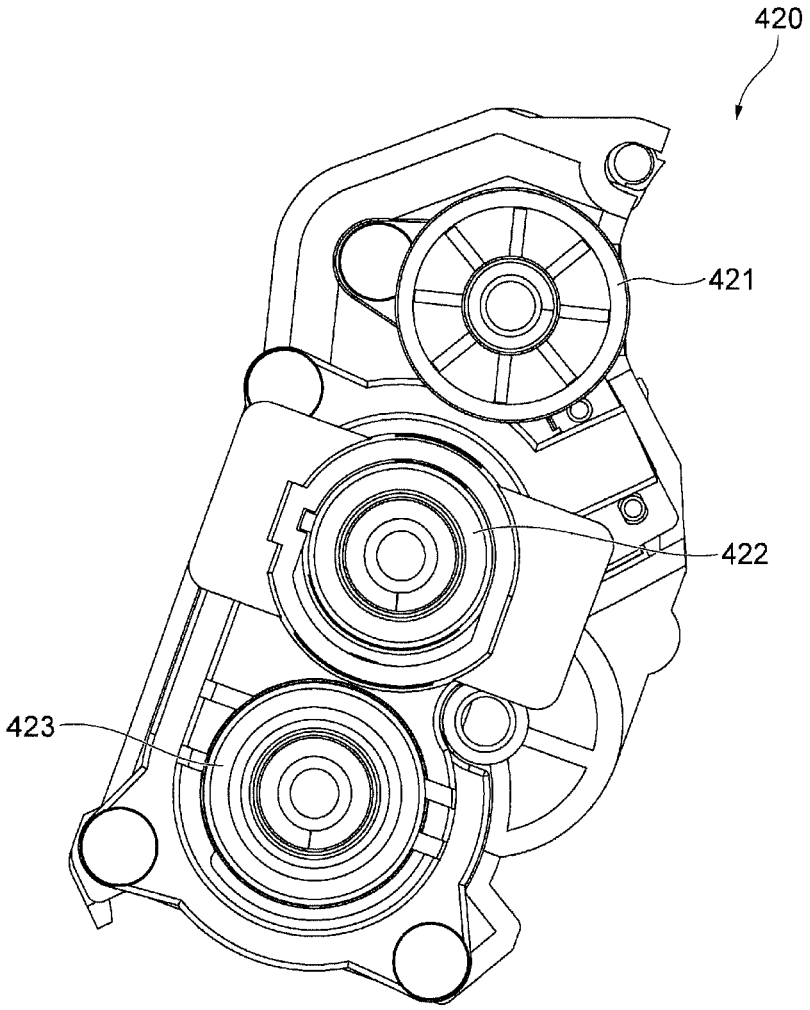
FIG. 25 is a side view of the developing apparatus included in the image forming apparatus of FIG. 24.
Figure 28:
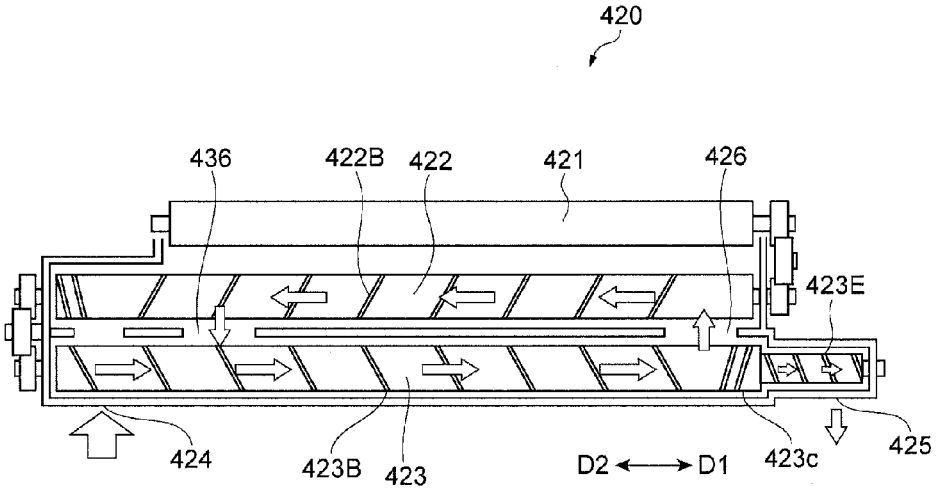
FIG. 28 is a view showing the flow of a developer inside the developing apparatus of FIG. 25.

The developing apparatus 420 employs a 2-component developing scheme. As illustrated in FIGS. 25 and 28, the developing apparatus 420 employs a developing scheme for replenishing the developer mixed with a new carrier when the toner is replenished into the developing apparatus 420 through a developer replenisher 424, and discharging the deteriorated developer out of the developing apparatus 420 through a developer discharger (discharger) 425 in an overflow manner. The developing apparatus 420 has an elongated shape. In addition to the above-described developing roller 421, the developing apparatus 420 includes an auger 422 for supplying the developer to the developing roller 421, and an auger (first auger) 423 extending in parallel to the auger 422 and provided adjacent to the auger 422.

The auger 422 and the auger 423 are augers for agitating and conveying the developer and may rotate at a speed equal to or higher than 400 rpm. The developer replenisher 424 is provided at a length-direction end of the developing apparatus 420, and the developer discharger 425 is provided at another length-direction end of the developing apparatus 420. The developer discharger 425 has a tubular shape protruding in a first direction D1 of the developing apparatus 420.

Figure 26:
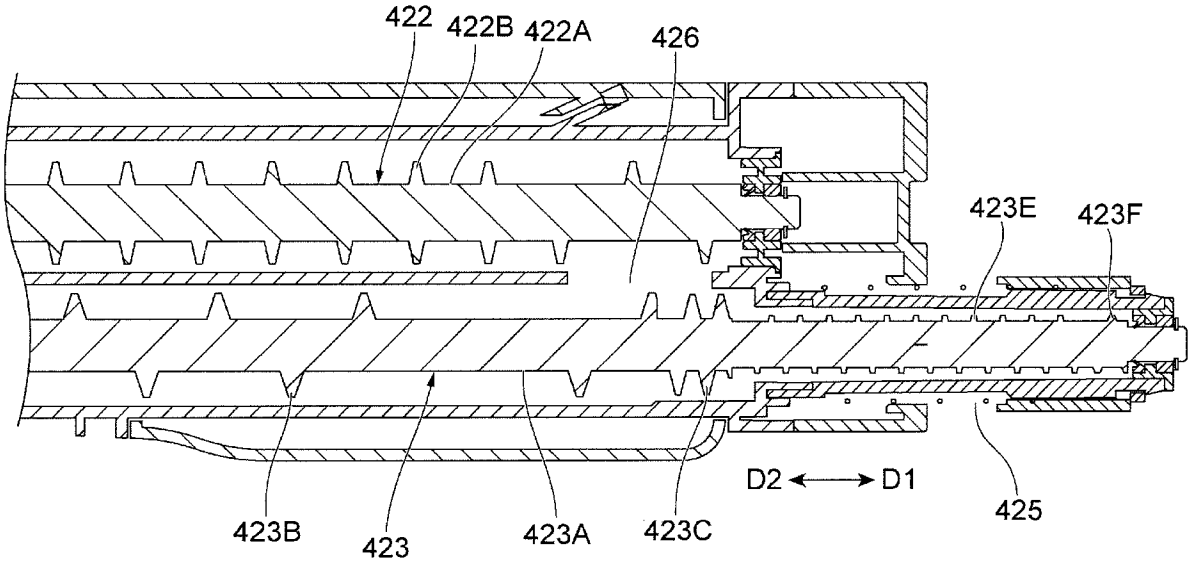
FIG. 26 is a cross-sectional view illustrating augers included in the developing apparatus of FIG. 25.
Figure 27:
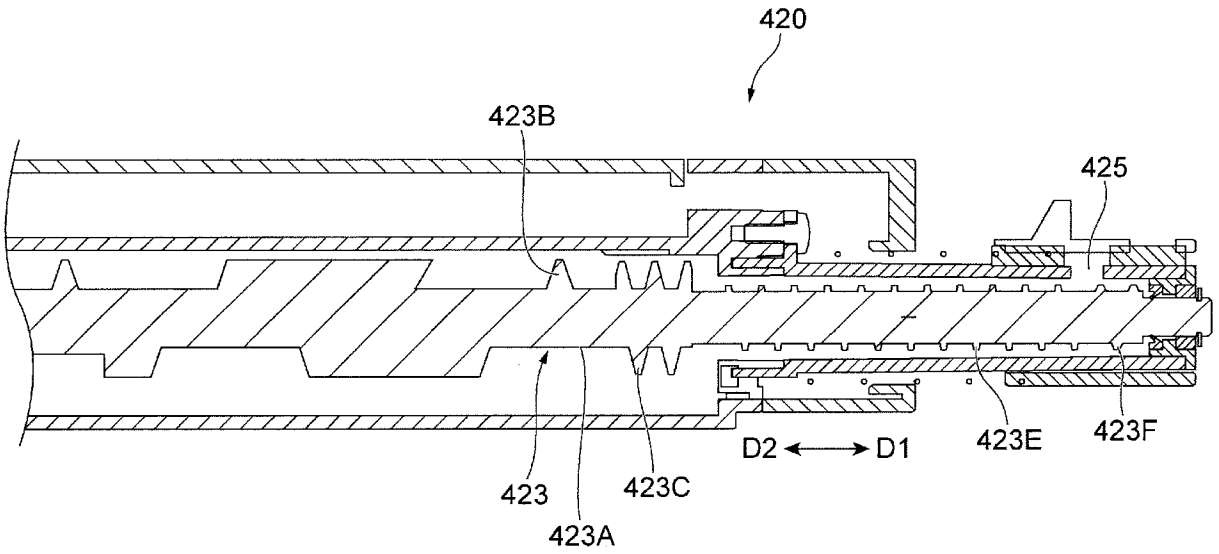
FIG. 27 is another cross-sectional view illustrating the augers included in the developing apparatus of FIG. 25.

As illustrated in FIGS. 26 and 27, the auger 422 includes a rotation shaft 422A, and a spiral blade 422B spirally protruding from the rotation shaft 422A. The auger 423 includes a rotation shaft 423A, and a spiral blade 423B spirally protruding from the rotation shaft 423A. The diameter of the rotation shaft 423A is, for example, 9 mm. The spiral blade 423B serves as a screw for agitating and conveying the developer. A first opening 426 is provided at ends of the auger 422 and the auger 423 in the first direction D1. Herein, the first direction D1 refers to a direction from the spiral blade 423B of the auger 423 toward the first opening 426.

A reverse spiral blade (first reverse conveyer) 423C for reversing the flow of the developer moving in the first direction D1 is provided in the first direction D1 of the auger 423 from the first opening 426. The reverse spiral blade 423C reverses the direction of the developer moving into the developer discharger 425. The reverse spiral blade 423C moves in a second direction D2 when the rotation shaft 423A of the auger 423 rotates. The second direction D2 is a direction opposite to the first direction D1. The developer discharger 425 is provided in the first direction D1 from (at one end of) the reverse spiral blade 423C. The diameter of the reverse spiral blade 423C is nearly equal to the diameter of the spiral blade 423B, but the pitch of the reverse spiral blade 423C is less than the pitch of the spiral blade 423B. Herein, the pitch refers to an interval between two adjacent axial-direction parts of each auger.

As illustrated in FIG. 28, the developer is replenished into the developing apparatus 420 through the developer replenisher 424 provided at an end of the developing apparatus 420 in the second direction D2. The developer replenished through the developer replenisher 424 is conveyed by the auger 423 in the first direction D1. The developer which reaches the first opening 426 located at an end of the first direction D1 moves toward the auger 422 through the first opening 426 and is conveyed in the second direction D2 by the auger 422 to be supplied to the developing roller 421. The developer which reaches a second opening 436 located at an end of the second direction D2 moves toward the auger 423 through the second opening 436. As described above, the developer circulates in the developing apparatus 420.

Figure 29:
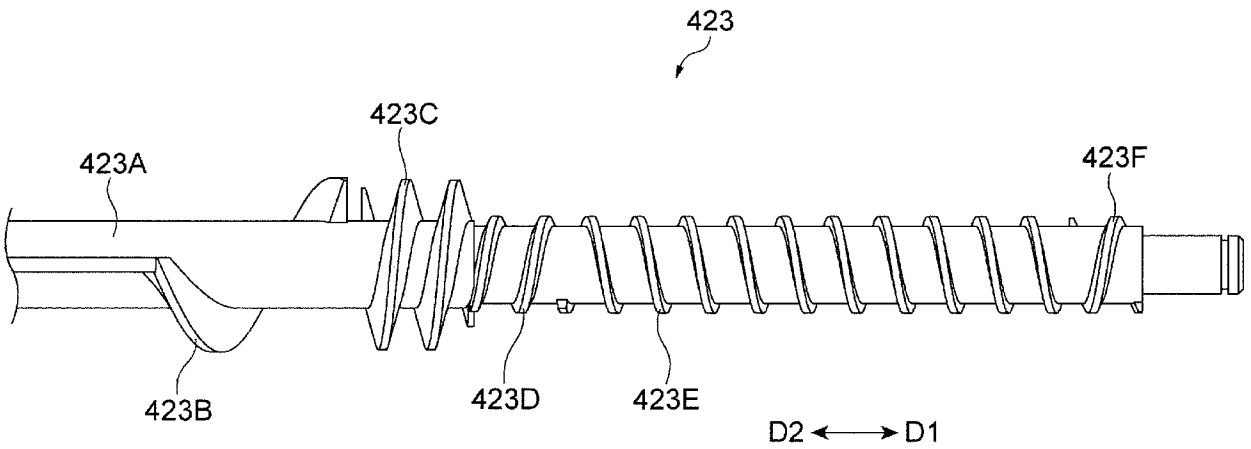
FIG. 29 is a perspective view of one of the augers illustrated in FIG. 26.

As illustrated in FIG. 29, reverse spiral blades 423D and 423F moving in the second direction D2 when the rotation shaft 423A rotates and a spiral blade 423E moving in the first direction D1 when the rotation shaft 423A rotates are provided in the first direction D1 of the reverse spiral blade 423C. The reverse spiral blades 423D and 423F and the spiral blade 423E are located in the developer discharger 425.

The rotation shaft 423A of the auger 423 and the reverse spiral blade (protrusion) 423D spirally protruding from the rotation shaft 423A serve as a second reverse conveyer for reversing the flow of the developer moved into the developer discharger 425. The reverse spiral blade 423D is located between the reverse spiral blade 423C and the spiral blade 423E in the developer discharger 425. The pitch of the reverse spiral blade 423D is nearly equal to the pitch of the reverse spiral blade 423C, but the diameter of the reverse spiral blade 423D is less than the diameter of the reverse spiral blade 423C. Accordingly, when the amount of the developer conveyed by the reverse spiral blade 423C is denoted by V1 and the amount of the developer conveyed by the reverse spiral blade 423D is denoted by V2, V1>V2 is satisfied.

The spiral blade 423E is located in the first direction D1 of the reverse spiral blade 423D. The spiral blade 423E serves as a discharge conveyer for conveying the developer filled inside the developer discharger 425 in the first direction (developer discharge direction) D1. The pitch of the spiral blade 423E is nearly equal to the pitch of the reverse spiral blade 423D, but the diameter of the spiral blade 423E is slightly greater than the diameter of the reverse spiral blade 423D. The length of the spiral blade 423E in an axial direction of the auger 423 is greater than the length of the reverse spiral blade 423D in the axial direction of the auger 423. Accordingly, when the amount of the developer conveyed by the reverse spiral blade 423D is denoted by V2 and the amount of the developer conveyed by the spiral blade 423E is denoted by V3, V2<V3 is satisfied. In addition, the reverse spiral blade 423F is located in the first direction D1 of the spiral blade 423E, and the pitch and the diameter of the reverse spiral blade 423F are nearly equal to the pitch and the diameter of the spiral blade 423E.

In the auger 423, for example, the diameter of the reverse spiral blade 423C may be 18 mm, the diameter of the reverse spiral blade 423D may be 10.5 mm, and the diameter of the spiral blade 423E may be 11 mm. The pitch of the reverse spiral blade 423C, the pitch of the reverse spiral blade 423D, and the pitch of the spiral blade 423E may be equal to each other, e.g., 5 mm. The reverse spiral blade 423C has a trapezoidal cross section protruding from the rotation shaft 423A. For example, the length of a bottom side thereof may be 2.5 mm, and the length of a top side thereof may be 1.0 mm. In addition, the width of the reverse spiral blade 423D may be equal to the width of the spiral blade 423E in the axial direction of the auger 423, e.g., 1.0 mm.

As described above, in the developing apparatus 420 and the image forming apparatus 401 including the developing apparatus 420, the reverse spiral blade 423D is located between the reverse spiral blade 423C and the spiral blade 423E in the developer discharger 425 into which the developer to be discharged flows. Thus, the developer dispersed near the developer discharger 425 is sent by the reverse spiral blade 423D in the second direction D2 which is opposite to the discharge direction. Therefore, dispersion and discharge of the necessary developer near the developer discharger 425 may be suppressed and thus the amount of the developer inside the developing apparatus 420 may be stabilized. Accordingly, problems caused by a reduction in the amount of the developer, e.g., image defections, may be suppressed.

In addition, since the developer dispersed near the developer discharger 425 is sent by the reverse spiral blade 423D in the second direction D2, the developer is not easily retained near the developer discharger 425. Thus, even when the auger 423 rotates at a high speed based on a high process speed of the image forming apparatus 401, discharge of the necessary developer may be prevented. Accordingly, since discharge of the necessary developer is prevented, the developing apparatus 420 may cope with a high process speed of the image forming apparatus 401.

Figure 30:
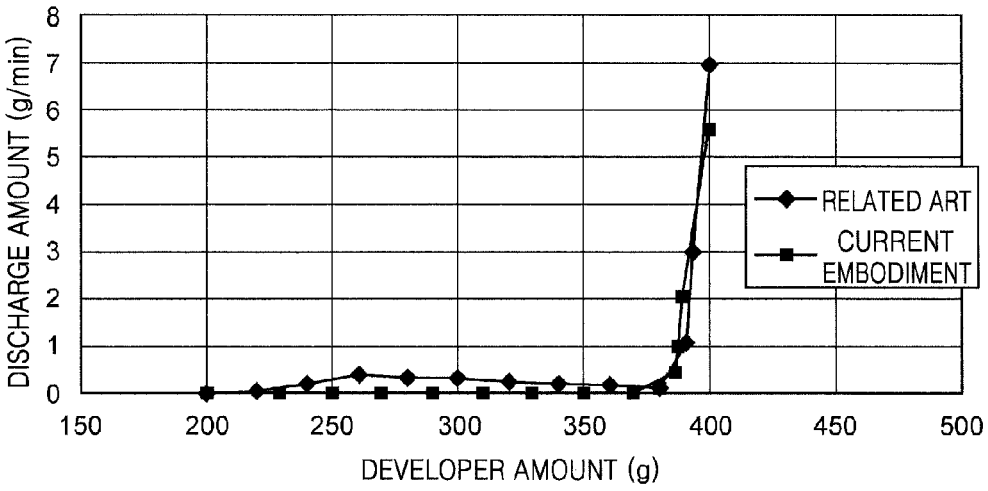
FIG. 30 is a graph showing the relation between the amount of the developer and a discharge amount.
Figure 31:
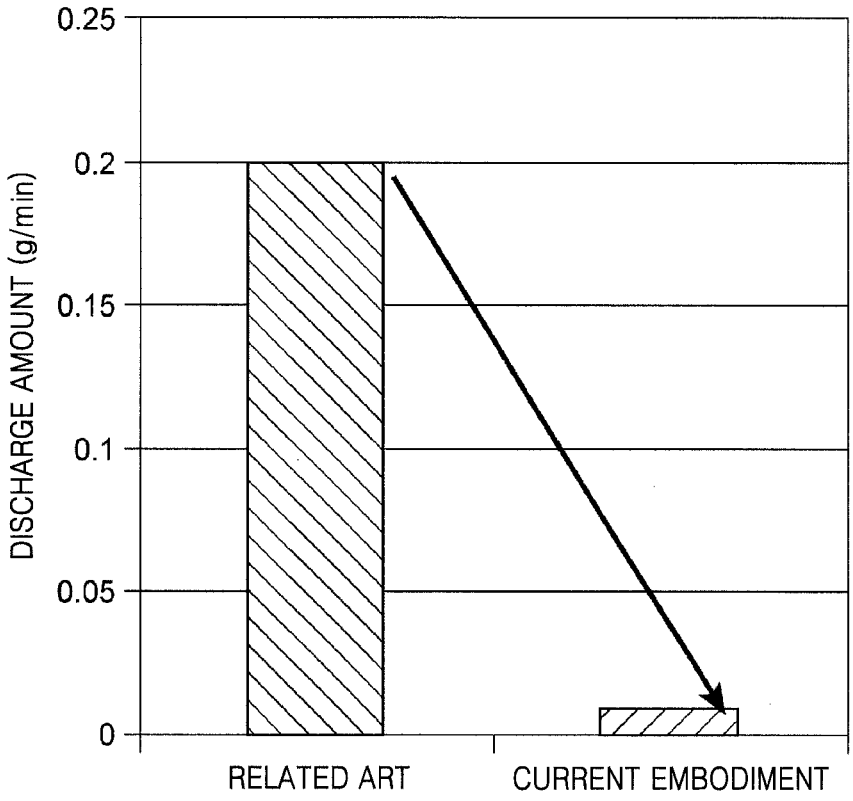
FIG. 31 is a graph for comparison with an excessive discharge amount.

FIGS. 30 and 31 are graphs showing developer discharge characteristics of the current embodiment and the related art when the image forming apparatus 401 outputs 60 sheets of the paper P every minute. FIG. 30 is a graph showing the relation between the amount of the developer inside the developing apparatus 420 (unit: g) and the discharge amount of the developer discharged from the developer discharger 425 (unit: g/min) As shown in FIG. 30, in the image forming apparatus 401, when the amount of the developer is less than 380 g, the discharge amount of the developer is 0.01 g/min in average. Accordingly, even when the image forming apparatus 401 operates for a long time, the amount of the developer inside the developing apparatus 420 may be maintained to about 380 g.

FIG. 31 is a graph showing the discharge amount of the developer (unit: g/min) when the amount of the developer inside the developing apparatus 420 is 320 g. As shown in FIG. 31, in the related art, since the discharge amount is about 0.2 g/min, if an image forming apparatus operates for a long time, the amount of a developer inside a developing apparatus is reduced. On the other hand, in the current embodiment, the discharge amount is equal to or less than 0.02 g/min and thus discharge of the necessary developer may be prevented. As described above, compared to the related art, the discharge amount of the developer may be reduced by about 95% in the current embodiment. Accordingly, even when the image forming apparatus 401 operates for a long time, the amount of the developer inside the developing apparatus 420 may be hardly reduced and may be stabilized by replenishing the developer.

In addition, as illustrated in FIG. 29, in the auger 423 of the developing apparatus 420, when the amount of the developer conveyed by the reverse spiral blade 423C is denoted by V1, the amount of the developer conveyed by the reverse spiral blade 423D is denoted by V2, and the amount of the developer conveyed by the spiral blade 423E is denoted by V3, V1>V2 is satisfied and, at the same time, V2<V3 is satisfied. By configuring the amounts of the developer conveyed by a plurality of spiral blades as described above, discharge of a surplus amount of the developer may be ensured and discharge of the necessary developer may be suppressed.

Furthermore, since the auger 423 includes the rotation shaft 423A and the reverse spiral blade 423D, discharge of the necessary developer may be suppressed and the amount of the developer inside the developing apparatus 420 may be stabilized. The auger 423 may rotate at a speed equal to or higher than 400 rpm. When the auger 423 rotates at a high speed equal to or higher than 400 rpm as described above, the effect of suppressing discharge of the developer may be further increased.

Sixth Embodiment

Figure 32:
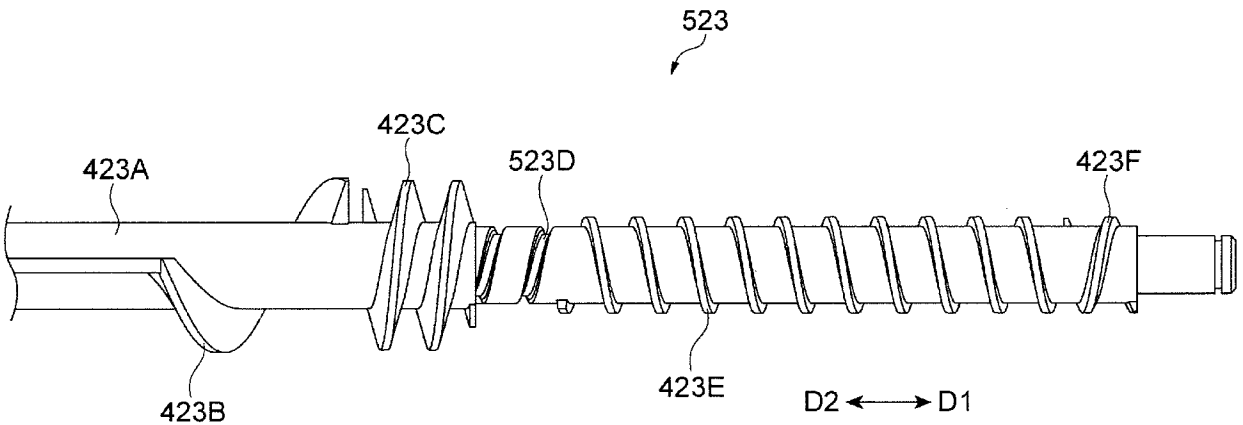
FIG. 32 is a perspective view of an auger of a developing apparatus according to a sixth embodiment.

As illustrated in FIG. 32, a developing apparatus according to the sixth embodiment is different from the fifth embodiment in that an auger 523 including a spiral groove (groove) 523D is used instead of the auger 423 including the reverse spiral blade 423D. The spiral groove 523D is located in the developer discharger 425. In the auger 523, the rotation shaft 423A, and the spiral groove 523D spirally recessed in the rotation shaft 423A serve as a second reverse conveyer for reversing the flow of the developer moved into the developer discharger 425. The pitch of the spiral groove 523D may be equal to or slightly less than, for example, the pitch of the reverse spiral blade 423C. In addition, for example, the width of the spiral groove 523D in an axial direction of the auger 523 may be 1.0 mm, and the depth of the spiral groove 523D may be 0.5 mm.

As described above, in the sixth embodiment, the auger 523 includes the rotation shaft 423A, and the spiral groove 523D spirally recessed in the rotation shaft 423A. Since the developer dispersed near the developer discharger 425 is sent by the spiral groove 523D in the second direction D2, discharge of the necessary developer may be suppressed and the amount of the developer inside the developing apparatus may be stabilized. Accordingly, the effect of the fifth embodiment may be equally achieved.

Seventh Embodiment

A developing apparatus according to the seventh embodiment is different from the sixth embodiment in that an auger including an oval plate is used instead of the auger 523 including the spiral groove 523D. The oval plate is provided on the rotation shaft 423A to be diagonal to the rotation shaft 423A. For example, two pieces of the oval plate are provided inside and outside the rotation shaft 423A. In the auger, the rotation shaft 423A and the oval plate serve as a second reverse conveyer for reversing the flow of the developer moved into the developer discharger 425. As in the seventh embodiment, even when the oval plate is provided, the developer dispersed near the developer discharger 425 is sent by the oval plate in the second direction D2. Accordingly, discharge of the necessary developer may be suppressed, the amount of the developer inside the developing apparatus may be stabilized, and thus the effect of the fifth and sixth embodiments may be equally achieved.

In the above-described fifth to seventh embodiments, for example, the auger 423 includes the spiral blades 423B and 423E, and the reverse spiral blades 423C, 423D, and 423F, but the location or size of each blade of the auger 423 may appropriately vary.

In addition, although the developer replenisher 424 is provided at an end of the developing apparatus 420 in the second direction D2 and the developer discharger 425 is provided at another end of the developing apparatus 420 in the first direction D1, the locations of the developer replenisher 424 and the developer discharger 425 are not limited thereto and may appropriately vary.

Furthermore, the developing apparatus according to the fifth to seventh embodiments may or may not have the features of any one of the above-described first to third embodiments.

The developing apparatus is required to cope with a wide range of process speed. To cope with a wide range of process speed, the amount of a developer inside a developer container may vary based on a difference in process speed. As such, the developing apparatus employing a trickle discharge scheme is required to maintain a stable amount of the developer even when the process speed of the developing apparatus varies.

A developing apparatus satisfying the above requirements includes a developer container for accommodating a developer, and a conveying member including a rotation shaft and a conveying blade spirally provided on an outer circumferential surface of the rotation shaft to convey the developer filled inside the developer container, and discharges the developer by overflowing the developer from developer container through a developer discharge port provided in a wall of the developer container at a location facing the conveying blade. The conveying blade provided at a location facing the developer discharge port may have a larger number of blade loops compared to a conveying blade provided at the other part, and a plurality of paddle members may be provided at the location facing the developer discharge port between parts of the conveying blade in an axial direction of the rotation shaft at different locations in the axial direction of the rotation shaft.

The developer discharge port may be provided in the wall of the developer container at a location where the conveying blade moves from a lower side toward an upper side of the gravity direction when the rotation shaft rotates.

Each of the paddle members may be a plate-shaped member for interconnecting two adjacent parts of the conveying blade, and the plurality of paddle members may have different heights from the center of the rotation shaft.

The plurality of paddle members may be provided at the same location in a rotation direction of the rotation shaft.

A lower end of the developer discharge port may be located at an upper side of the gravity direction compared to a rotation center of the rotation shaft.

According to the above-described developing apparatus, even when the process speed of the developing apparatus varies, a stable amount of the developer may be maintained.

A developing apparatus and an image forming apparatus capable of stabilizing the amount of a developer and coping with a high process speed of the image forming apparatus by suppressing a reduction in the amount of the developer caused by dispersion of the developer are required.

A developing apparatus satisfying the above requirements includes an auger for agitating and conveying a developer, and a discharger provided at an end of the auger to discharge the developer. The auger includes a screw for agitating and conveying the developer, a first reverse conveyer for reversing the flow of the developer moving into the discharger, a discharge conveyer for conveying the developer filled inside the discharger in a discharge direction, and a second reverse conveyer provided between the first reverse conveyer and the discharge conveyer in the discharger to reverse the direction of the developer moved into the discharger.

In the above-described developing apparatus, when the amount of the developer conveyed by the first reverse conveyer is denoted by V1 and the amount of the developer conveyed by the second reverse conveyer is denoted by V2, V1>V2 may be satisfied. In addition, when the amount of the developer conveyed by the second reverse conveyer is denoted by V2 and the amount of the developer conveyed by the discharge conveyer is V3, V2<V3 may be satisfied.

In the above-described developing apparatus, the second reverse conveyer may include a rotation shaft, and a protrusion spirally protruding from the rotation shaft. Alternatively, the second reverse conveyer may include a rotation shaft, and a groove spirally recessed in the rotation shaft. Otherwise, the second reverse conveyer may include a rotation shaft, and an oval plate provided on the rotation shaft to be diagonal to the rotation shaft.

In addition, a rotation speed of the auger may be equal to or higher than 400 rpm.

While the developing apparatuses and the image forming apparatuses of the present invention have been particularly shown and described with reference to exemplary embodiments thereof, it will be understood by one of ordinary skill in the art that various changes in form and details may be made therein without departing from the spirit and scope of the present invention as defined by the following claims.

The invention claimed is:

1. A developing apparatus comprising:

a first auger for conveying a developer in a first direction;

a second auger extending in parallel to the first auger to convey the developer in a second direction opposite to the first direction;

an opening for delivering the developer from the first auger to the second auger;

a discharger located in the first direction from the opening to discharge the developer conveyed by the first auger; and a retention member provided on at least one of the first auger and the second auger and having at least one end in the first direction provided to substantially correspond to an end of the opening in the first direction to retain the developer conveyed by the first and second augers.

2. The developing apparatus of claim 1, wherein the retention member retains the developer near the opening.

3. The developing apparatus of claim 2, wherein the retention member comprises a first retention member provided at a location of the second auger facing the opening to retain the developer delivered through the opening toward the second auger, near the opening.

4. The developing apparatus of claim 3, wherein the retention member further comprises a second retention member provided on the second auger at a downstream side of the first retention member based on the second direction to retain the developer conveyed by the second auger.

5. The developing apparatus of claim 4, wherein a developer retention capability of the second retention member is lower than the developer retention capability of the first retention member.

6. The developing apparatus of claim 5, wherein the second retention member is provided at a location within a range corresponding to 1.5 times of a pitch of a spiral blade of the second auger from the first retention member.

7. The developing apparatus of claim 6, wherein each of the first and second retention members comprises at least one of a paddle extending from a rotation shaft of the second auger in an axial direction and a radial direction, a spiral blade having a pitch smaller than that of a spiral blade of the second auger, and a diameter-enlarged part having a diameter greater than the diameter of the rotation shaft of the second auger.

8. The developing apparatus of claim 1, wherein a reverse conveyer for reversing flow of the developer conveyed in the first direction is provided at a location of the first auger between the discharger and the opening.

9. The developing apparatus of claim 1, wherein, when an angle formed between a horizontal plane and a straight line for interconnecting a rotation center of the first auger and a rotation center of the second auger is denoted by $\theta$, $45° \leq \theta \leq 90°$ is satisfied.

10. An image forming apparatus comprising the developing apparatus of claim 1.

11. A developing apparatus comprising:

a first auger for conveying a developer in a first direction;

a second auger extending in parallel to the first auger to convey the developer in a second direction opposite to the first direction;

an opening for delivering the developer from the first auger to the second auger;

a discharger located in the first direction from the opening to discharge the developer conveyed by the first auger; and a retention member provided on at least one of the first auger and the second auger and having at least one end in the first direction provided to substantially correspond to an end of the opening in the first direction to retain the developer conveyed by the first and second augers, wherein the discharger comprises a developer discharge port provided in a wall of a developer container for accommodating the developer, to face the first auger, wherein the developer discharge port is provided in the wall in a direction moving from a lower side toward an upper side of a gravity direction when the first auger rotates, and wherein a lower end of the developer discharge port is located at an upper side of the gravity direction compared to a rotation center of a rotation shaft of the first auger.

12. The developing apparatus of claim 11, wherein the first auger comprises a conveying blade spirally provided on an outer circumferential surface of the rotation shaft, and wherein a number of blade loops of the conveying blade at a location of the first auger facing the developer discharge port is greater than that of another region.

13. The developing apparatus of claim 11, wherein the retention member comprises a plurality of paddle members provided at a location of the first auger facing the developer discharge port at different locations in an axial direction of the rotation shaft.

14. The developing apparatus of claim 13, wherein the plurality of paddle members discharge the developer through the developer discharge port by applying a force to the developer when the first auger rotates.

15. The developing apparatus of claim 13, wherein at least one of the plurality of paddle members has a different height from a center of the rotation shaft compared to others.

16. The developing apparatus of claim 13, wherein the plurality of paddle members are provided at the same location in a rotation direction of the rotation shaft.

17. A developing apparatus comprising:

a first auger for conveying a developer in a first direction;

a second auger extending in parallel to the first auger to convey the developer in a second direction opposite to the first direction;

an opening for delivering the developer from the first auger to the second auger;

a discharger located in the first direction from the opening to discharge the developer conveyed by the first auger; and a retention member provided on at least one of the first auger and the second auger to retain the developer conveyed by the first and second augers, wherein the first auger comprises:

a first reverse conveyer provided at a location between the discharger and the opening to reverse flow of the developer conveyed in the first direction;

a discharge conveyer located in the first direction from the first reverse conveyer to convey the developer in the first direction; and a second reverse conveyer located between the first reverse conveyer and the discharge conveyer to reverse flow of the developer.

18. The developing apparatus of claim 17, wherein, when an amount of the developer conveyed by the first reverse conveyer is denoted by V1 and an amount of the developer conveyed by the second reverse conveyer is denoted by V2, $V1 > V2$ is satisfied.

19. The developing apparatus of claim 18, wherein, when an amount of the developer conveyed by the discharge conveyer is denoted by V3, $V2 < V3$ is satisfied.

20. The developing apparatus of claim 17, wherein a rotation speed of the first auger is equal to or higher than 400 rpm.

* * * * *